US009611643B2

(12) United States Patent
Evensen et al.

(10) Patent No.: US 9,611,643 B2
(45) Date of Patent: Apr. 4, 2017

(54) SYSTEMS AND METHODS FOR PROVIDING A WINDOW WALL WITH FLUSH SLAB EDGE COVERS

(71) Applicant: Reflection Window Company, LLC, Chicago, IL (US)

(72) Inventors: Kenneth R. Evensen, Naperville, IL (US); James Jonathan White, Singapore (SG)

(73) Assignee: REFLECTION WINDOW COMPANY, LLC, Chicago, IL (US)

( * ) Notice: Subject to any disclaimer, the term of this patent is extended or adjusted under 35 U.S.C. 154(b) by 0 days.

(21) Appl. No.: 14/590,745

(22) Filed: Jan. 6, 2015

(65) Prior Publication Data

US 2015/0113891 A1 Apr. 30, 2015

Related U.S. Application Data

(62) Division of application No. 13/889,116, filed on May 7, 2013, now Pat. No. 8,959,855.

(51) Int. Cl.
*E04B 2/96* (2006.01)
*E04B 2/90* (2006.01)
(Continued)

(52) U.S. Cl.
CPC ..... *E04B 2/96* (2013.01); *E04B 2/885* (2013.01); *E04B 2/90* (2013.01); *E04F 13/08* (2013.01);
(Continued)

(58) Field of Classification Search
CPC .... E04B 2/96; E04B 2/885; E04B 2/90; E04F 13/08; E04F 13/0803; E06B 1/16;
(Continued)

(56) References Cited

U.S. PATENT DOCUMENTS 2,885,040 A * 5/1959 Grossman ..... E04B 2/96 49/235
2,960,195 A * 11/1960 Toth ..... E04B 2/96 52/206
(Continued)

OTHER PUBLICATIONS

Definition of Flush, Collins Dictionary, 2016, accessed May 24, 2016, http://www.collinsdictionary.com/dictionary/english/flush.*
(Continued)

*Primary Examiner* — James Ference
(74) *Attorney, Agent, or Firm* — McAndrews, Held & Malloy, Ltd.

(57) ABSTRACT

Certain embodiments provide systems and methods for providing a window wall with flush slab edge covers. A window wall system can include a sill receptor configured to fixably attach to a top surface of a slab. The window wall system may include a head receptor configured to fixably attach to an underside surface of the slab. The window wall system can include a window wall panel including panel infill and a panel sill configured to detachably couple to the sill receptor. The window wall system may include a slab edge cover including cover infill. The slab edge cover can be configured to detachably couple to the window wall panel and the head receptor. In various embodiments, an exterior surface of the panel infill and an exterior surface of the cover infill are configured to flushly align when the slab edge cover is detachably coupled to the window wall panel.

18 Claims, 29 Drawing Sheets

(51) Int. Cl.

| | |
|---|---|
| ***E06B 1/16*** | (2006.01) |
| ***E06B 1/18*** | (2006.01) |
| ***E06B 1/36*** | (2006.01) |
| ***E06B 1/40*** | (2006.01) |
| ***E06B 3/54*** | (2006.01) |
| ***E06B 3/68*** | (2006.01) |
| ***E06B 7/14*** | (2006.01) |
| ***E04B 2/88*** | (2006.01) |
| *E04F 13/08* | (2006.01) |

(52) U.S. Cl.
CPC ..... *E06B 1/16* (2013.01); *E06B 1/18* (2013.01); *E06B 1/366* (2013.01); *E06B 1/40* (2013.01); *E06B 3/5427* (2013.01); *E06B 3/5454* (2013.01); *E06B 3/68* (2013.01); *E06B 7/14* (2013.01); *E04F 13/0803* (2013.01); *E06B 2003/5472* (2013.01); *E06B 2007/145* (2013.01)

(58) Field of Classification Search
CPC ... E06B 1/18; E06B 1/366; E06B 1/40; E06B 3/5427; E06B 3/5454; E06B 3/68; E06B 7/14; E06B 2003/5472; E06B 2007/145; E06B 2003/145
See application file for complete search history.

(56) References Cited

U.S. PATENT DOCUMENTS 3,038,568 A * 6/1962 Morgan ..... E04B 2/90 52/204.7
3,052,330 A * 9/1962 Hammitt ..... E04B 2/96 52/235
3,205,630 A * 9/1965 Felix ..... E04B 2/7818 52/204.591
3,246,441 A * 4/1966 Horgan, Jr. ..... E04B 2/88 52/204.7
3,315,426 A * 4/1967 Rolland ..... E04B 2/90 292/115
3,439,601 A * 4/1969 Cooper ..... F24F 7/06 165/54
3,579,943 A * 5/1971 Tam ..... E06B 1/18 52/656.2
3,719,014 A * 3/1973 Sukolics ..... E06B 3/5842 52/235
3,936,986 A * 2/1976 Steel ..... E04B 2/94 52/235
4,055,923 A * 11/1977 Biebuyck ..... E06B 7/14 52/204.591
4,449,341 A * 5/1984 Taglianetti ..... E04B 2/88 52/235
4,561,228 A * 12/1985 Kaminaga ..... E04B 2/96 52/204.591
4,614,069 A * 9/1986 Tanikawa ..... E04B 1/98 52/204.591
4,662,135 A * 5/1987 Tanikawa ..... E04B 2/92 52/235
4,662,136 A * 5/1987 Tanikawa ..... E04B 2/90 52/235
4,662,145 A * 5/1987 Tanikawa ..... E04B 2/88 52/235
4,899,508 A * 2/1990 Biebuyck ..... E04B 2/962 52/235
4,918,897 A * 4/1990 Luedtke ..... E04B 1/16 52/291
5,036,637 A * 8/1991 Biebuyck ..... E04B 2/96 52/204.591
5,046,293 A * 9/1991 Kajiura ..... E06B 1/6015 52/101
5,048,257 A * 9/1991 Luedtke ..... E04B 1/16 52/364
5,077,947 A * 1/1992 Takeda ..... E04B 2/94 52/235
5,127,202 A * 7/1992 Yokota ..... E04C 2/384 52/235
5,154,029 A * 10/1992 Sturgeon ..... E06B 7/14 52/235
5,216,858 A * 6/1993 Gilmour ..... E04B 2/96 52/235
5,253,459 A * 10/1993 Parinas ..... E04B 2/96 52/204.591
5,267,419 A * 12/1993 Yokota ..... E04B 2/90 52/235
5,309,689 A * 5/1994 Croissant ..... E04B 2/967 52/235
5,323,577 A * 6/1994 Whitmyer ..... E04B 2/96 52/209
5,355,645 A * 10/1994 Farag ..... E06B 3/5427 52/235
5,369,924 A * 12/1994 Neudorf ..... E06B 3/5427 52/200
5,381,637 A * 1/1995 Farag ..... E06B 3/5427 52/204.593
5,579,616 A * 12/1996 Farag ..... E06B 3/5427 52/204.5
5,822,935 A * 10/1998 Mitchell ..... E04B 2/7455 52/220.7
5,839,236 A * 11/1998 Frey ..... E04B 2/965 52/235
6,425,218 B1 * 7/2002 Doyon ..... E04F 13/081 403/295
6,804,920 B2 * 10/2004 Hogan ..... E04B 2/96 52/204.5
6,857,233 B2 2/2005 Farag
7,096,629 B1 * 8/2006 Cox ..... E04F 13/0814 52/235
7,424,793 B1 * 9/2008 Shriver ..... E04B 2/88 52/235
7,644,549 B2 1/2010 Speck
7,827,746 B2 11/2010 Speck
7,832,160 B2 * 11/2010 Farag ..... B32B 17/10 52/204.57
7,856,775 B2 * 12/2010 Stahl, Jr. ..... E04B 2/88 52/1
7,987,644 B2 * 8/2011 Walker, III ..... E04B 2/90 52/202
8,001,738 B2 8/2011 Ting
2002/0144476 A1 * 10/2002 Mastelli ..... E04B 2/96 52/235
2002/0148178 A1 * 10/2002 Farag ..... E04B 2/96 52/204.1
2004/0154249 A1 8/2004 Mastelli
2006/0016133 A1 * 1/2006 Speck ..... E04B 2/96 52/79.1
2006/0185274 A1 * 8/2006 Merica ..... E04B 2/90 52/235
2006/0201084 A1 * 9/2006 Arias ..... E04B 2/965 52/235
2009/0199498 A1 * 8/2009 Ting ..... E04B 2/90 52/235
2010/0050547 A1 3/2010 Speck
2010/0186315 A1 * 7/2010 Tambakakis ..... E06B 3/5427 52/167.1

OTHER PUBLICATIONS

Askins, Joseph, "Construction checkup: EnV" website: http://yochicago.com/consruction-checkup-ev-2113634/, 2 pages, Jan. 4, 2010.

Valerio Dewalt Train & Associates Inc., "Typical Slab Edge," Job Name "161 West Kinzie," Nov. 21, 2008, sheet M-07, 1 page.

VOA Associates Inc., Basis of Design: Window Wall; Cupples/ES Windows ES-W625 Structurally Glazed Window Wall System, Project No. 2971A-00, Oct. 17, 2008 (Plot Date), Sheet No. A3-004.

(56) References Cited

OTHER PUBLICATIONS

Ting Wall Inc., "TinWall Window Wall System (Updated Sep. 6, 2011), U.S. Pat. No. 8,001,738," Ting Wall Bulletin No. 134, Sep. 6, 2011, pp. 1-3.
Ting Wall Inc., "Aesthetic Comparisons of Window Wall Systems (Sep. 6, 2011)," Ting Wall Bulletin No. 134a, Sep. 6, 2011, 2 pages.

* cited by examiner 1
25
120
A
9
8
18
31
22
100
2
7
19
3
11
23
14
13
4
28
6
20
B
24
30
15
29
32
34
5
110
10
12
27
17
21
16

100
120
110
10
5
16
120

226
223
220
228
216
201
231
221A
320
213
208
206
202
207
203
204
214
206
216
229
217
212
210
202
300
B
B
310
227
214
225
205
215
221B
230
203
216
207
202
213
206
208
216
320
201
223
209
219
202
222
211
231

SYSTEMS AND METHODS FOR PROVIDING A WINDOW WALL WITH FLUSH SLAB EDGE COVERS

CROSS-REFERENCE TO RELATED APPLICATIONS/INCORPORATION BY REFERENCE

The present application is a divisional and claims priority under 35 U.S.C. §121 to co-pending U.S. patent application Ser. No. 13/889,116, filed on May 7, 2013. The entire contents of the above-mentioned prior-filed application are hereby expressly incorporated herein by reference.

FEDERALLY SPONSORED RESEARCH OR DEVELOPMENT

[Not Applicable]

MICROFICHE/COPYRIGHT REFERENCE

[Not Applicable]

FIELD OF THE INVENTION

Certain embodiments of the invention relate to systems and methods for providing a window wall with flush slab edge covers. More specifically, certain embodiments provide detachably coupled slab edge covers that flushly align with window wall panels while controlling the removal of water that enters the system.

BACKGROUND OF THE INVENTION

Window wall is a term generally used in the construction industry to describe a window system that spans between floors of a building, for example, from a top of a bottom floor slab to the underside of an above floor slab. Sill and head receptors are installed using anchors or embeds and shims to tightly set the receptors parallel to one another on the same plane and at the correct height to accept the unitized window panels. Below the sill receptor and above the head receptor, a gap exists where receptors have been shimmed to level, and a weather seal caulk is applied to both the exterior and interior sides of the receptors to seal the gaps between the slab and receptors from air and water infiltration. In window wall systems using vertical terminations, a jamb receptor is used to receive a unitized panel. Caulk is also applied to any gaps behind the jamb receptors.

Some existing window wall systems include a slab edge cover, which is an extruded or formed profile that clips, hooks or is fastened to the head receptor and the sill receptor along the entire length of the window system. In window wall systems that include slab edge covers, the slab edge covers may not be used at balcony conditions or in areas that an architect or designer wants exposed substrate, for example. The slab edge covers can be constructed from aluminum, glass, stone, or any suitable material. The slab edge covers can be installed from the interior with the window panels, or after the window panels are installed by using scaffolding and mounting the slab edge covers from the exterior.

During installation of an exemplary existing window wall system, the bottom of the unitized panels are placed into the sill receptor at an upward projection, commonly referred to as a "chicken head," that locks the panel into place by keying into the lower horizontal of the panel and notches cut into the bottom of the frame verticals. The chicken head includes gaskets, typically applied in the factory, which prevent air and water from entering the system at the sill. Sealants are also applied at the sill in critical areas to help in sealing the system.

After placing the unitized panel into the sill receptor, the panel is tipped forward and rotated into the head receptor extrusion and is stopped from tipping too far forward (away from the building) by an extruded arm in the head receptor that has a factory installed gasket. The arm makes contact with the top horizontal of the panel and the panel verticals, which have been notched out at the factory in the front to allow the glass to move beyond the arm. Another longer arm with a factory installed gasket in the head receptor extrusion creates a seal to the glass when the panel is tipped in place. When the panel is tipped into the vertical position, it is then slid in a direction toward another installed panel or jamb receptor, along the sill and head to interlock with the adjacent panel using a male/female connection extruded into the verticals of both panels. A separate L-shaped drive-on extrusion is driven into the interior side of the head receptor extrusion and locked into place by way of serrated teeth and leverage, holding the panel tightly into the head receptor. A factory installed gasket on the drive-on fits snugly against the panel's top horizontal and verticals to create a tight seal. Sealant is applied to critical areas to ensure a tight air and water seal.

The above-mentioned exemplary window wall installation process is repeated from the starting floor to the top of the building.

Unitized curtain wall differs from unitized window wall in a number of ways, with one of the most noticeable differences being the appearance from the exterior. A curtain wall panel is hung outside the building structure from an anchoring system located on top of, in front of, or immediately under the building floor slab or substrate. In many cases, embeds, which are anchor stabilizers placed in the concrete form work before the concrete is poured, are used. When the concrete cures, the embeds are encased in the concrete providing a secure means of connection to the window system. In curtain wall systems, embeds are typically necessary because of the extreme forces that curtain wall exert to the outer edge of the concrete slab, and are relatively expensive to provide when labor and material are considered. In most cases, each vertical mullion at each floor includes an embed and a connection. The connections may provide vertical and/or lateral support. In conditions where steel is used, the anchoring system is welded to the steel structure. Window wall generally does not require embeds as the system is deep enough into the building structure to support the lateral and vertical loads.

Because the curtain wall is held outside the buildings structure, a gap between the slab edge and the back of the curtain wall exists. Fire stopping material is used to fill the gap between the slab edge and the back of the current wall to prevent inter story jumping of flames and smoke in the event of a fire. The fire stopping is also relatively expensive to provide considering the cost of labor and material for installation at each slab edge/curtain wall condition. Window wall does not require fire stopping because the slab edge extends beyond the interior of the system.

In addition to inter story fire stopping, inter story sound proofing is also a concern with a curtain wall system. Although the fire safing insulation provides some sound absorption qualities, additional sound proofing to curtain wall gaps is typically needed to mitigate the migration of sound between floors of a building. Because curtain wall mullions extend between floors, the sound may also travel through the hollows of the mullions unless soundproofing is built into the system. Window wall systems do not require inter story sound proofing because the slab edge, which extends beyond the interior of the system, acts as the sound proofing.

Another disadvantage to curtain wall is that it is more difficult to transition to the inside of the building structure, as is needed for inset balcony conditions. Curtain wall has to change from a top hung system to a system that dead loads to the top of the slab, making it vulnerable to performance issues in those transitioned areas. Window wall is entirely dead loaded onto the slab and no special engineering is needed to bring the system deeper into the building structure. Further, window wall offers two silicone or other caulk chemical seals at each receptor, one on the interior and one on the exterior, ensuring a redundant barrier against air and water. Curtain wall relies on mechanical seals, in the form of gaskets, in most areas of its system.

In general, a curtain wall system requires more equipment, labor and specialized materials to install, than a window wall system. Since the panels of a curtain wall system are hung from above, the entire panel has to be lifted up to the connections above or dropped down with hoisting equipment from the floor above. Window wall is installed from the floor in which it will be placed and does not have to be lifted any further than the height of the sill.

To some architects and designers, curtain wall has a more appealing look than window wall, since curtain wall is mounted outside the building structure, the system does not require a protruding slab edge cover, giving it a smooth, flush faced look if it is a four-sided structurally glazed system. Although window wall systems can be aesthetically pleasing and perform well in thermal air and water testing, architects and designers at times desire a flush face system where the entire exterior is on the same vertical plane.

Further limitations and disadvantages of conventional and traditional approaches will become apparent to one of skill in the art, through comparison of such systems with some aspects of the present invention as set forth in the remainder of the present application with reference to the drawings.

BRIEF SUMMARY OF THE INVENTION

Systems and methods for providing a window wall with flush slab edge covers is provided, substantially as shown in and/or described in connection with at least one of the figures, as set forth more completely in the claims.

These and other advantages, aspects and novel features of the present invention, as well as details of an illustrated embodiment thereof, will be more fully understood from the following description and drawings.

Figure 1:
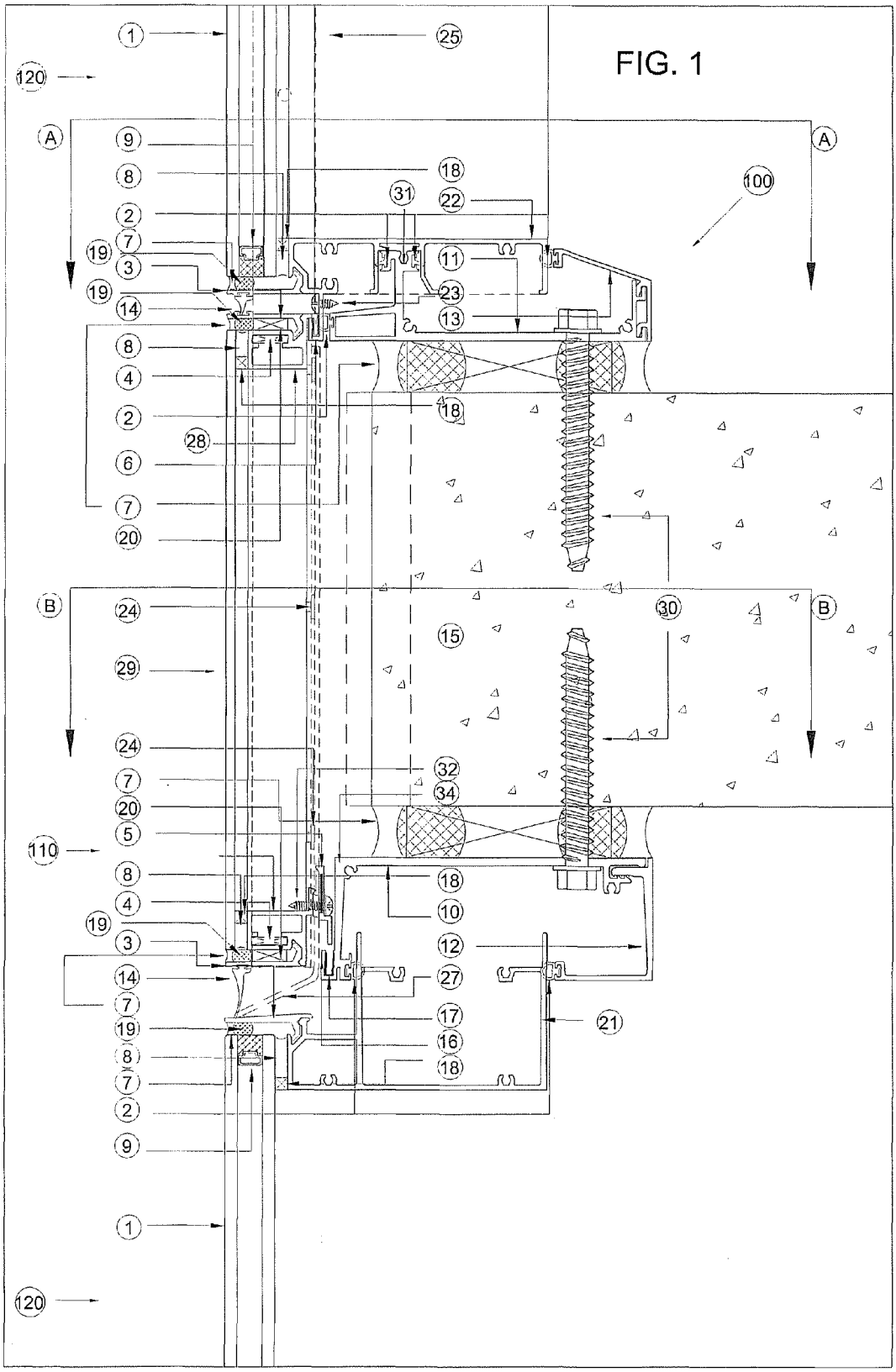
FIG. 1 is a diagram that illustrates a cross-sectional view of an exemplary first embodiment of a window wall system with a slab edge cover in an open position and flushly aligned with adjacent window wall panels in accordance with an embodiment of the present invention.

The foregoing summary, as well as the following detailed description of certain embodiments of the present invention, may be better understood when read in conjunction with the appended drawings. For the purpose of illustrating the invention, certain embodiments are shown in the drawings. It should be understood, however, that the present invention is not limited to the arrangements and instrumentality shown in the attached drawings.

DETAILED DESCRIPTION

Certain embodiments of the invention may be found in systems and methods for providing a window wall 100 with slab edge covers 110 flushly aligned with window wall panels 120. More specifically, certain embodiments provide detachably coupled slab edge covers 110 that flushly align with adjacent window wall panels 120 while controlling the removal of water that enters the system 100.

Various embodiments provide a window wall system 100 including a sill receptor 11 configured to fixably attach to a top surface of a slab 15. The window wall system 100 may include a head receptor 10 configured to fixably attach to an underside surface of the slab 15. The window wall system 100 can include a window wall panel 120 including panel infill 1 and a panel sill 22 configured to detachably couple to the sill receptor 11. The window wall system 100 may include a slab edge cover 110 including cover infill 29. The slab edge cover 110 can be configured to detachably couple to the window wall panel 120 and the head receptor 10. In various embodiments, an exterior surface of the panel infill 1 and an exterior surface of the cover infill 29 are configured to flushly align when the slab edge cover 110 is detachably coupled to the window wall panel 120.

Certain embodiments provide a method 2700 for installing a slab edge cover 110 of a window wall system 100. The method 2700 includes detachably coupling 2710 the slab edge cover 110 to a window wall panel 120. The method 2700 includes receiving 2720 a panel sill 22 of the window wall panel 120 at a sill receptor 11. The method includes receiving 2730 a panel head 21 of the window wall panel 120 at a head receptor 10. The method 2700 includes sliding 2740 a transmission bar clip 5 of the slab edge cover 110 to couple the slab edge cover 110 to the head receptor 10.

Aspects of the present invention provide a window wall system 300. The window wall system 300 can comprise a sill receptor 210 configured to fixably attach to a top surface of a slab 214. The window wall system 300 may comprise a head receptor 209 configured to fixably attach to an underside surface of the slab 214. The window wall system 300 can comprise a window wall panel 320 comprising panel infill 201 and a panel sill 220 configured to detachably couple to the sill receptor 210. The window wall system 300 may comprise one or more slab edge covers 310 comprising cover infill 225. The one or more slab edge covers can be configured to detachably couple to the sill receptor 210 and the head receptor 209. In various embodiments, an exterior surface of the panel infill 201 and an exterior surface of the cover infill 225 can be configured to flushly align when the window wall panel 320 is detachably coupled to the sill receptor 210 and the at least one slab edge cover 310 is detachably coupled to the sill receptor 210 and the head receptor 209.

Various embodiments provide a method 3000 for installing a slab edge cover 310 of a window wall system 300. The method 3000 can comprise receiving 3010 a panel clip 205 of the slab edge cover 310 at a head receptor 209. The method 3000 may comprise receiving 3020 the slab edge cover 310 at the sill receptor 210. The method 3000 can comprise securing 3030 the slab edge cover 310 to the sill receptor 210 with at least one attachment mechanism 229. In certain embodiments, the slab edge cover 310 and a window wall panel 320 installed adjacent to the slab edge cover 310 may be flushly aligned. In various embodiments, each of the window wall panel 320 and the slab edge cover 310 can be a four-sided structurally glazed system.

FIG. 1 is a diagram that illustrates a cross-sectional view of an exemplary first embodiment of a window wall system 100 with a slab edge cover 110 in an open position and flushly aligned with adjacent window wall panels 120 in accordance with an embodiment of the present invention. Referring to FIG. 1, the window wall system 100 comprises a head receptor 10, a sill receptor 11, window wall panels 120, and a slab edge cover 110 flushly aligned in a vertical plane with the window wall panels 120 and detachably coupled with at least one of the window wall panels 120. The sill receptor 11 and head receptor 10 are securely attached to a slab 15 using anchors 30, embeds, welding, or any suitable coupling mechanism. The slab 15 can be concrete, wood, a metal tube, metal I-beam, or any suitable supportive material. In various embodiments, backer rod and a weather seal 7, such as silicone caulk, can be applied between the receptors 10, 11 and the slab 15 to provide a seal against air and water infiltration.

Certain embodiments provide that the head receptor 10 and/or the sill receptor 11 are extended such that the head receptor 10 and/or the sill receptor 11 are coupled to the slab at an increased distance from the edge of the slab 15. Coupling the head receptor 10 and/or the sill receptor 11 at an increased distance from the edge of the slab 15 provides greater support for the window wall panels 120 and slab edge covers 110, and allows the attachment mechanism 30 that couples the head receptor 10 and/or the sill receptor 11 to the slab 15 to be accessible, for example. As an example, various embodiments provide that the attachment mechanism 30 that mounts the head receptor 10 and/or sill receptor 11 to the slab 15 is behind, or farther from the edge of the slab than, an installed panel head 19 and/or sill 20, respectively, as illustrated in FIG. 1. More specifically, a horizontal distance from the edge of the slab 15 to a center of the affixed attachment mechanism 30 of the head receptor 10 and/or sill receptor 11 is greater than a horizontal distance from the edge of the slab 15 to the building interior edge of an installed panel head 19 and/or panel sill 20, respectively.

The sill receptor 11 can include a detachably coupled sill trim 13 for providing access to the anchor 30 or any suitable attachment mechanism. The sill receptor 11 is configured to receive a panel sill 22 of a window wall panel 120 at an upward projection 31, commonly referred to as a "chicken head." The panel sill 22 dead loads on the upward projection 31 to provide a press or wedge fit, for example. The upward projection 31 and the sill trim 13 may include gaskets 2 to provide a seal against air and water infiltration. The gaskets 2 can be ethylene propylene diene monomer (EPDM), silicone, or any suitable material, for example. In various embodiments, the panel sill 22 includes an integral panel clip 6 for detachably coupling with a protrusion of the slab cover frame 28. The integral panel clip 6 assists in securing the slab edge cover 110 to the window wall panel 120 when coupled with the slab cover frame 28 protrusion.

The slab edge cover 110 and window wall panels 120 may be a four-sided structurally glazed system where the slab cover infill 29 is coupled to the slab cover frame 28, and the wall panel infill 1 is coupled to the panel head 21, panel sill 22, and vertical mullions 35, 36 on both sides by structural caulk 8. The slab cover infill 29 and panel infill 1 may be insulated glass, stone, metal, wood, or any suitable material. In various embodiments, insulated vision glass can be used for the panel infill 1 and spandrel glass may be used for the slab cover infill 29, for example. The structural caulk 8 can be silicone or any suitable material. In various embodiments, glazing tape 18 can be used with the structural caulk 8 to prevent seepage of the structural caulk during application.

Figure 3:
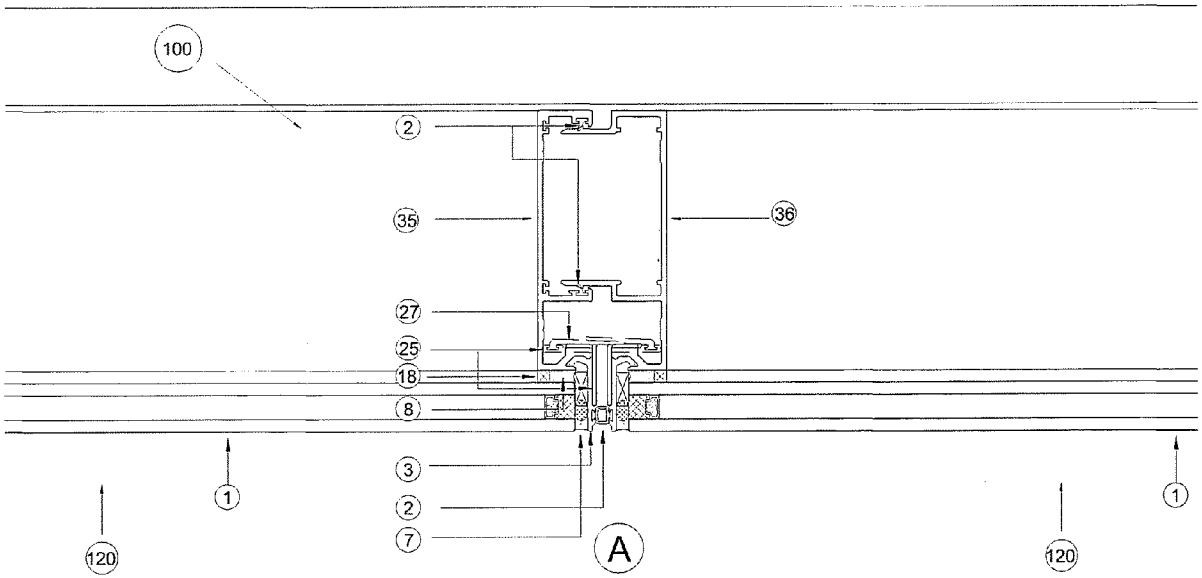
FIG. 3 is a diagram that illustrates a top plan view of an exemplary first embodiment of a window wall system at vertical mullions in accordance with an embodiment of the present invention.

The window wall panels 120 can include panel infill 1, glazing beading 3, a panel head 21, a panel sill 22, and vertical mullions 35, 36, as illustrated in FIG. 3, for example. The window wall panels 120 are secured at a bottom side of slab 15 at a head receptor 10 that receives and secures the panel head 21. The window wall panels 120 are secured at a top side of slab 15 at a sill receptor 11 that receives and secures the panel sill 22. The window wall panels 120 are coupled to horizontally adjacent window wall panels 120 at vertical mullions 35, 36, which may be a male vertical mullion 35 and a female vertical mullion 36, as illustrated in FIG. 3, for example. In various embodiments, glazing beading 3 may be provided to protect the infill 1. The glazing beading 3 can be nylon or any suitable material, for example. A weather seal 7 may be provided between the glazing beading 3 and the panel infill 1 to provide a barrier to water, for example. The weather seal 7 can be silicone, polyurethane, or any suitable material. In certain embodiments, a foam backer rod 19 may be used with the weather seal 7 to prevent seepage of the weather seal 7 during application. In various embodiments, the window wall panel 120 may be an insulated glass unit that includes insulated glass spacer bars 9 between the panes of glass 1.

Referring to FIG. 1, the slab edge cover 110 may include a slab cover frame 28, infill 29, and a sliding transmission bar clip 5, among other things. The slab edge cover infill 29 can be secured within the slab cover frame 28, and glazing beading 3 may be provided to protect the cover infill 29. The glazing beading 3 can be nylon or any suitable material, for example. A wiper gasket 14 can be attached to the base of the glazing beading 3 to prevent water from entering the window wall system 100. The wiper gasket 14 may be ethylene propylene diene monomer (EPDM) or any suitable material, for example. Glass setting blocks 20 may be provided between the infill 29 edge and the glazing beading 3 to act as a spacer. The glass setting blocks 20 can be ethylene propylene diene monomer (EPDM), silicone, or any suitable material, for example. Weather seals 7 may be provided between the glazing beading 3 and the infill 29 to provide a barrier to water, for example. The weather seals 7 can be silicone, polyurethane, or any suitable material. In certain embodiments, a foam backer rod 19 may be used with the weather seal 7 to prevent seepage of the weather seal 7 during application. The slab cover frame 28 can include pockets at each corner of the slab cover frame 28 for receiving L-shaped corner keys 4. The L-shaped corner keys tie the vertical portions of the slab cover frame 28 to the horizontal portions of the slab cover frame 28. The corner keys 4 may be aluminum or any suitable material, for example.

Figure 11:
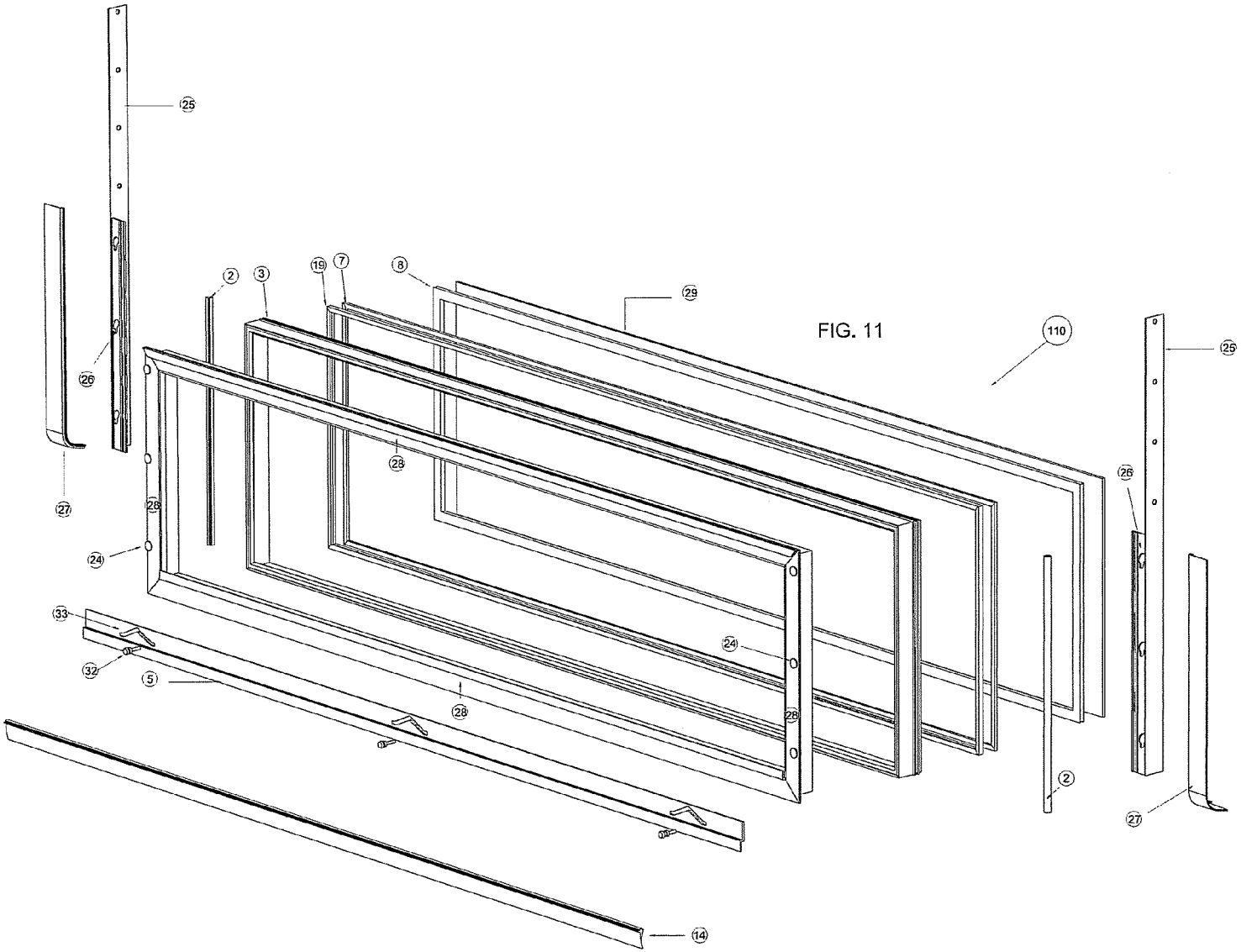
FIG. 11 is a diagram that illustrates an exploded front perspective view of an exemplary first embodiment of a slab edge cover with support arms in accordance with an embodiment of the present invention.

The sliding transmission bar clip 5 is a mechanism for detachably coupling the slab edge cover 110 to the head receptor 10. In various embodiments, the sliding transmission bar clip 5 is a continuous transmission bar comprising slots 33 for receiving a screw 32 to slidably attach the sliding transmission bar clip 5 to the slab edge cover frame 28, as illustrated in FIG. 11, for example. In certain embodiments, the sliding transmission bar clip 5 can extend horizontally beyond an edge of the slab cover frame 28 when the slab edge cover 110 is in an open position (i.e., when the slab edge cover 110 is not coupled to the head receptor 10). The sliding transmission bar clip 5 can lock the slab edge cover 110 to the head receptor 10 by applying a horizontal force towards the slab cover frame 28 to the edge of the sliding transmission bar clip 5 that extends beyond the slab cover frame 28. The horizontal force applied to the sliding transmission bar clip 5 forces the sliding transmission bar clip 5 to slide, as guided by slots 33, such that the sliding bar clip 5 couples with a head receptor clip 16 of the head receptor 10. In various embodiments, the sliding transmission bar clip 5 can be slid by accessing the sliding transmission bar clip 5 from a slot (not shown) in the head receptor 10, for example. As an example, during a blind install when an installer does not have access to the bottom side of the panel, such as when installing a leave-out panel or a jamb panel, the slot in the head receptor 10 allows an installer to access the transmission bar clip 5 to provide the horizontal force to slide the transmission bar clip 5 into the head receptor clip 16 to lock the slab edge cover 110.

Although certain embodiments may describe the sliding transmission bar clip 5 as sliding as guided by slots 33, for example, unless so claimed, the scope of various aspects of the present invention should not be limited to using slots 33 and may additionally and/or alternatively be applicable to any suitable mechanism for coupling the sliding transmission bar clip 5 to the head receptor 10. For example, certain embodiments provide that the sliding transmission bar clip 5 is horizontally slidable in a track (not shown) coupled to the slab cover frame 28, and comprises clips (not shown) that detachably couple with head receptor clips 16 when a horizontal force towards the slab cover frame 28 is applied to the edge of the sliding transmission bar clip 5 that extends beyond the slab cover frame 28.

As another example, various embodiments provide that the sliding transmission bar clip 5 can be a stationary transmission bar clip. The stationary transmission bar clip can share various characteristics with the sliding transmission bar clip 5 in a locked position. During installation of a slab edge cover 110 detachably coupled to a window wall panel 120, the detachably coupled window wall panel 120 and slab edge cover 110 may be positioned vertically such that the panel sill 22 is above the sill receptor 11 and the stationary transmission bar clip 5 is above the head receptor clip 16. When the detachably coupled window wall panel 120 and slab edge cover 110 is appropriately positioned, the detachably coupled window wall panel 120 and slab edge cover 110 can be lowered such that the sill receptor 11 receives the panel sill 22 and the head receptor clip 16 receives the stationary transmission bar clip 5. In certain embodiments, glass cups, among other things, can be used to position and maneuver the detachably coupled window wall panel 120 and slab edge cover 110, for example.

In certain embodiments, the slab edge cover 110 can include a backpan (not shown) for holding insulation, such as mineral wool insulation, vacuum insulated panels, or any suitable insulation for improving the thermal performance of the window wall system 100. In various embodiments, insulation may be attached to the edge of the slab 15. In certain embodiments, the window panel infill 1 and/or the slab edge cover infill 29 can be vacuum insulated glass.

Various embodiments provide that the slab edge cover 110 is detachably coupled to an adjacent window wall panel 120, such as the window wall panel 120 above the slab edge cover 110 as shown in FIG. 1. The slab edge cover 110 can be coupled to the window wall panel 120 prior to installation to provide a more efficient installation process, for example. The slab edge cover 110 is detachable from the window wall panel 120 such that the slab 15, insulation (not shown) between the slab 15 and the slab edge cover 110, and/or components of the window wall system 100 can be accessed for maintenance purposes, among other things.

As illustrated in FIGS. 5-15, the vertical sides of the slab cover frame 28 can include hanging studs 24 for detachably coupling to clip connections 26 of a support arm 25 that extends vertically above the slab edge cover 110 and attaches to the vertical sides of the window wall panel 120 frame. The support arm 25 detaches from the slab edge cover frame 28 at the clip connections 26 by lifting the slab edge cover 110 toward the above window wall panel 120 and pulling the slab edge cover 110 away from the slab 15. Further, as the slab edge cover 110 is lifted, the integral panel clip 6 detaches from the protrusion of the slab cover frame 28, and the sliding transmission bar clip 5 detaches from the head receptor clip 16.

Alternatively, the vertical sides of the slab cover frame 28 can be attached to a support arm 25 that extends vertically above the slab edge cover 110 and detachably coupled to hanging studs 25 in the vertical sides of the window wall panel 120 frame using clip connections 26 or any suitable attachment mechanism. The support arm 25 detaches from the window wall panel 120 frame at the clip connections 26 by lifting the slab edge cover 110 toward the above window wall panel 120 and pulling the slab edge cover 110 away from the slab 15. Further, as the slab edge cover 110 is lifted, the integral panel clip 6 detaches from the protrusion of the slab cover frame 28, and the sliding transmission bar clip 5 detaches from the head receptor clip 16.

The slab edge cover 110 can be reattached to the adjacent window wall panel 120 and the head receptor clip by pushing the slab edge cover 110 towards the slab 15 and lowering the slab edge cover 110 such that the hanging studs 25 reattach with the clip connections 26, the integral panel clip 6 reattaches with the protrusion of the slab cover frame 28, and the sliding transmission bar clip 5 reattaches with the head receptor clip 16. Aspects of the present invention provide a set screw 23 and/or wedge block (not shown) between the slab edge cover 110 and the above window wall panel 120 to prevent unintentional removal of the slab edge cover 110 from the above window wall panel 120 and the head receptor 10. The set screw 23 and/or wedge block (not shown) may be removed to allow the slab edge cover 110 to be lifted such that the slab edge cover can detach from the above window wall panel 120 and the head receptor 10. The set screw 23 and/or wedge block (not shown) may be refastened after the slab edge cover 110 is reattached to the above window wall panel 120 and the head receptor 10.

Referring again to FIG. 1, the head receptor 10 can include a head receptor drive-on 12, a head receptor arm 34, and a head receptor clip 16. The head receptor drive-on 12 is attached to the head receptor 10 after the head receptor 10 is securely attached to the slab 15, and a panel head 21 of a window wall panel 120 is received at the head receptor 10. The head receptor drive-on 12, when attached to the head receptor 10, compresses the panel head 21 against the head receptor arm 34 to hold the panel in place at the head receptor 10. The compression fitting of the panel head 21 between the head receptor drive-on 12 and the head receptor arm 34 may include gaskets 2 to provide a seal against air and water infiltration. The gaskets 2 can be ethylene propylene diene monomer (EPDM), silicone, or any suitable material, for example. In various embodiments, the head receptor arm 34 may include a head receptor clip 16. The head receptor clip 16 is configured to receive the sliding transmission bar clip 5 when the window wall system 100 is in a locked position (i.e., when the slab edge cover 110 is locked to the head receptor 10), as illustrated at least in FIGS. 2 and 6, for example. In certain embodiments, the head receptor clip 16 and/or the sliding transmission bar clip 5 may include an anti-friction pad 17 for allowing the transmission bar clip 5 to easily slide into the head receptor clip 16 while preventing damage to the transmission bar clip 5 and head receptor clip 16. For example, during high winds the two metals can rub together creating unwanted sounds and damage to the system. The anti-friction pad 17 can provide a surface that protects a metal to metal engagement. The anti-friction pad 17 can be nylon or any suitable anti-friction material, for example.

In various embodiments, the support arms 25 each include a support arm gasket 27. In certain embodiments, the support arm gaskets 27 may extend from the bottom of the panel sill 22 of the window wall panel 120 above the slab edge cover 110 to the top of the glazing beading 3 of window wall panel 120 below the slab edge cover 110. The support arm gaskets 27 of adjacent slab edge covers 110 provide a channel to direct water behind the slab edge covers 110 and out the front of the window wall system 100 between the slab edge cover 110 and the window wall panel 120 below the slab edge cover 110.

Various embodiments provide that the slab edge cover 110 is flushly aligned with adjacent window wall panels 120. More specifically, the exterior surface of the infill 1 of the window wall panels 120 are aligned with the exterior surface of the infill 29 of the slab edge covers 110 such that the exterior surface of the window wall system 100 is substantially without protrusions.

Figure 2:
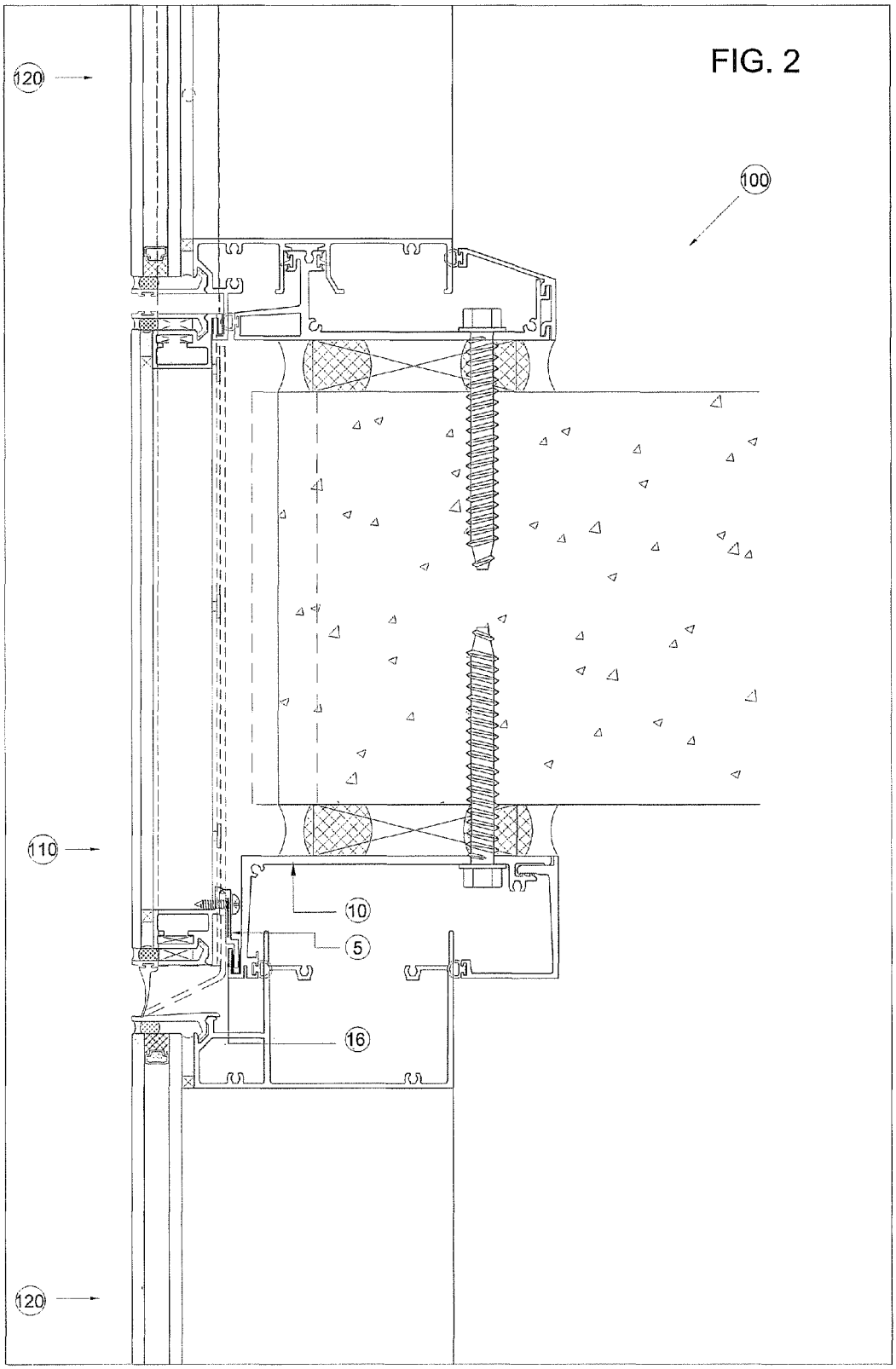
FIG. 2 is a diagram that illustrates a cross-sectional view of an exemplary first embodiment of a window wall system with a slab edge cover in a locked position and flushly aligned with adjacent window wall panels in accordance with an embodiment of the present invention.

FIG. 2 is a diagram that illustrates a cross-sectional view of an exemplary first embodiment of a window wall system 100 with a slab edge cover 110 in a locked position and flushly aligned with adjacent window wall panels 120 in accordance with an embodiment of the present invention. The window wall system 100 illustrated in FIG. 2 shares various characteristics with the window wall system 100 illustrated in FIG. 1, as described above. Referring to FIG. 2, the sliding transmission bar clip 5 is coupled to the head receptor clip 16 of the head receptor 10 such that the slab edge cover 110 of the window wall system 100 is in a locked position.

FIG. 3 is a diagram that illustrates a top plan view of an exemplary first embodiment of a window wall system 100 at vertical mullions 35, 36 in accordance with an embodiment of the present invention. Referring to FIG. 3, the window wall system 100 includes window wall panels 120. The window wall panels 120 include panel infill 1 and vertical mullions 35, 36. The window wall panels 120 may be a four-sided structurally glazed system where the wall panel infill 1 is coupled to the vertical mullions 35, 36, by structural caulk 8. The panel infill 1 may be insulated glass, stone, metal, wood, or any suitable material. In various embodiments, insulated vision glass can be used for the panel infill 1, for example. The structural caulk 8 can be silicone or any suitable material. In various embodiments, glazing tape 18 can be used with the structural caulk 8 to prevent seepage of the structural caulk during application.

The window wall panels 120 are coupled to horizontally adjacent window wall panels 120 at vertical mullions 35, 36, which may be a male vertical mullion 35 and a female vertical mullion 36, for example. The coupling of the vertical mullions 35, 36 may include gaskets 2 to provide a seal against air and water infiltration. The gaskets 2 can be ethylene propylene diene monomer (EPDM), silicone, or any suitable material, for example. In various embodiments, glazing beading 3 may be provided to protect the infill 1. In various embodiments, gaskets 2 may be provided between the glazing beading 3 of horizontally adjacent window wall panels 120 to prevent air and water infiltration. A weather seal 7 may be provided between the glazing beading 3 and the panel infill 1 to provide a barrier to water, for example. The weather seal 7 can be silicone, polyurethane, or any suitable material. In certain embodiments, a foam backer rod 19 may be used with the weather seal 7 to prevent seepage of the weather seal 7 during application.

In various embodiments, support arms 25 may be detachably coupled to the vertical mullions 35, 36 to provide a mechanism for detachably coupling a slab edge cover 110 to a vertically adjacent window wall panel 120 as discussed above with regard to FIG. 1, for example. The support arms 25 can each include a support arm gasket 27 that provides a channel to direct water out the front of the window wall system 100 between the slab edge cover 110 and the window wall panel 120 below the slab edge cover 110.

The window wall system 100 illustrated in FIG. 3 shares various characteristics with the window wall system 100 illustrated in FIGS. 1-2, as described above.

Figure 4:
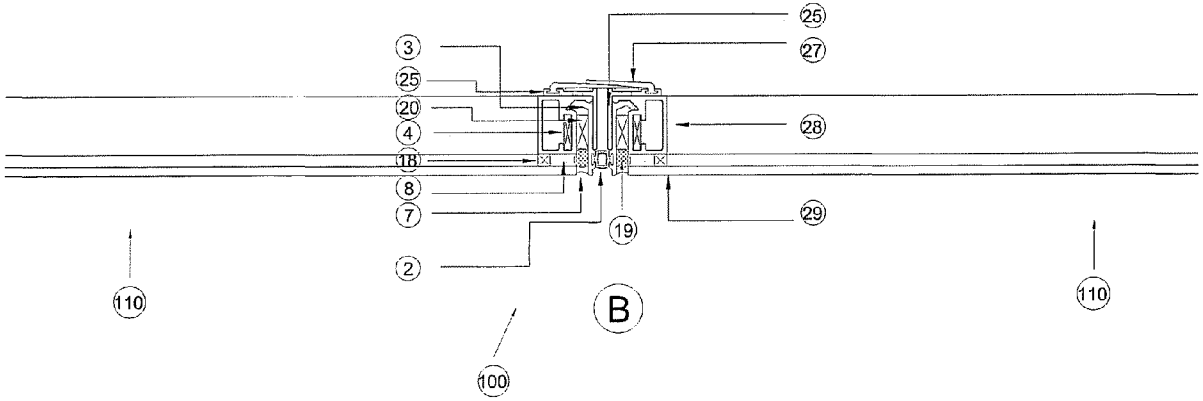
FIG. 4 is a diagram that illustrates a top plan view of a top plan view of an exemplary first embodiment of a window wall system at the slab edge covers in accordance with an embodiment of the present invention.

FIG. 4 is a diagram that illustrates a top plan view of an exemplary first embodiment of a window wall system 100 at the slab edge covers 110 in accordance with an embodiment of the present invention. Referring to FIG. 4, the window wall system 100 includes slab edge covers 110. The slab edge covers 110 include slab edge cover infill 29 and slab edge cover frames 28. The slab edge covers 110 may be a four-sided structurally glazed system where the slab cover infill 29 is coupled to the slab cover frame 28 by structural caulk 8. The slab cover infill 29 may be insulated glass, stone, metal, wood, or any suitable material. In various embodiments, spandrel glass may be used for the slab cover infill 29, for example. The structural caulk 8 can be silicone or any suitable material. In various embodiments, glazing tape 18 can be used with the structural caulk 8 to prevent seepage of the structural caulk during application.

The slab edge cover infill 29 can be secured within the slab cover frame 28, and glazing beading 3 may be provided to protect the cover infill 29. Glass setting blocks 20 may be provided between the infill 29 edge and the glazing beading 3 to act as a spacer. The glass setting blocks 20 can be ethylene propylene diene monomer (EPDM) or any suitable material, for example. Weather seals 7 may be provided between the glazing beading 3 and the infill 29 to provide a barrier to water, for example. The weather seals 7 can be silicone, polyurethane, or any suitable material. In certain embodiments, a foam backer rod 19 may be used with the weather seal 7 to prevent seepage of the weather seal 7 during application. The slab cover frame 28 can include pockets at each corner of the slab cover frame 28 for receiving L-shaped corner keys 4. The L-shaped corner keys tie the vertical portions of the slab cover frame 28 to the horizontal portions of the slab cover frame 28. The corner keys 4 may be aluminum or any suitable material, for example.

In various embodiments, support arms 25 may be detachably coupled to the slab cover frame 28 to provide a mechanism for detachably coupling the slab edge cover 110 to a vertically adjacent window wall panel 120 as discussed above with regard to FIG. 1, for example. The support arms 25 can each include a support arm gasket 27 that provides a channel to direct water out the front of the window wall system 100 between the slab edge cover 110 and the window wall panel 120 below the slab edge cover 110.

The window wall system 100 illustrated in FIG. 4 shares various characteristics with the window wall system 100 illustrated in FIGS. 1-3, as described above.

Figures 5, 6:
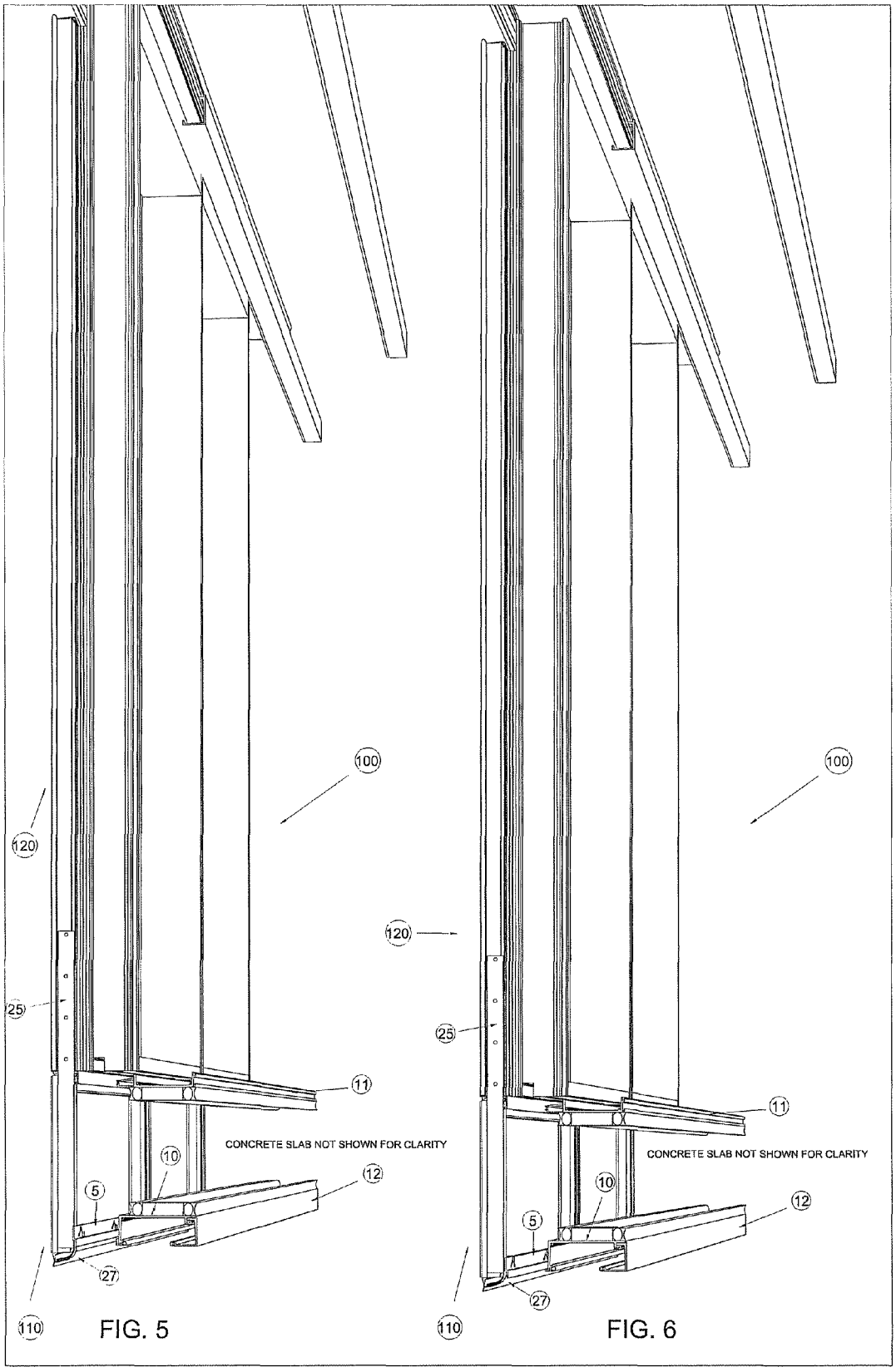
FIG. 5 is a diagram that illustrates a rear side perspective view of an exemplary first embodiment of a window wall system with a slab edge cover in an open position and flushly aligned with an adjacent window wall panel in accordance with an embodiment of the present invention.
FIG. 6 is a diagram that illustrates a rear side perspective view of an exemplary first embodiment of a window wall system with a slab edge cover in a locked position and flushly aligned with an adjacent window wall panel in accordance with an embodiment of the present invention.

FIG. 5 is a diagram that illustrates a rear side perspective view of an exemplary first embodiment of a window wall system 100 with a slab edge cover 110 in an open position and flushly aligned with an adjacent window wall panel 120 in accordance with an embodiment of the present invention. Referring to FIG. 5, the window wall system 100 comprises a head receptor 10, a sill receptor 11, a window wall panel 120, and a slab edge cover 110 detachably coupled and flushly aligned in a vertical plane with the window wall panel 120. The slab edge cover 110 and window wall panel 120 may each be a four-sided structurally glazed system. The sill receptor 11 and head receptor 10 are securely attached to a slab (not shown). The sill receptor 11 is configured to receive a panel sill of the window wall panel 120. The head receptor 10 is configured to receive a panel head of a below window wall panel (not shown) and may include a head receptor drive-on 12 for holding the below window wall panel in place at the head receptor 10.

In various embodiments, the slab edge cover 110 can include a sliding transmission bar clip 5 for detachably coupling the slab edge cover 110 to the head receptor 10. The sliding transmission bar clip 5 is a continuous transmission bar that extends horizontally beyond an edge of the slab cover frame 28 when the slab edge cover 110 is in an open position (i.e., when the slab edge cover 110 is not coupled to the head receptor 10), as illustrated in FIG. 5. The sliding transmission bar clip 5 can lock the slab edge cover 110 to the head receptor 10 by applying a horizontal force towards the slab cover frame 28 to the edge of the sliding transmission bar clip 5 that extends beyond the slab cover frame 28. The horizontal force applied to the sliding transmission bar clip 5 forces the sliding transmission bar clip 5 to slide such that the sliding bar clip 5 couples with the head receptor 10.

Certain embodiments provide a support arm 25 attached to the vertical sides of the window wall panel 120 frame and extending vertically to detachably couple with the slab edge cover 110 frame. The support arm 25 can detach from the slab edge cover frame 28 by lifting the slab edge cover 110 toward the above window wall panel 120 and pulling the slab edge cover 110 away from the slab, for example. Further, as the slab edge cover 110 is lifted, the sliding transmission bar clip 5 detaches from the head receptor 10. The slab edge cover 110 can be reattached to the adjacent window wall panel 120 and the head receptor 10 by pushing the slab edge cover 110 towards the slab and lowering the slab edge cover 110 such that the sliding transmission bar clip 5 reattaches with the head receptor 10, and the slab cover 110 frame reattaches with the support arm 25 by an attachment mechanism such as the clip connections 26 and hanging studs 24 described above with regard to FIG. 1, for example.

In various embodiments, the support arm 25 can include a support arm gasket 27. The support arm gaskets 27 of adjacent slab edge covers 110 provide a channel to direct water behind the slab edge covers 110 and out the front of the window wall system 100 between the slab edge cover 110 and the window wall panel 120 below the slab edge cover 110.

The window wall system 100 illustrated in FIG. 5 shares various characteristics with the window wall system 100 illustrated in FIGS. 1-4, as described above.

FIG. 6 is a diagram that illustrates a rear side perspective view of an exemplary first embodiment of a window wall system 100 with a slab edge cover 110 in a locked position and flushly aligned with an adjacent window wall panel 120 in accordance with an embodiment of the present invention. The window wall system 100 illustrated in FIG. 6 shares various characteristics with the window wall system 100 illustrated in FIG. 5, as described above. Referring to FIG. 6, the sliding transmission bar clip 5 is coupled to the head receptor 10 such that the slab edge cover 110 of the window wall system 100 is in a locked position. For example, the transmission bar clip 5 illustrated in FIG. 6 does not extend beyond an edge of the slab cover frame 28 after being slid into a locked position.

Figure 7:
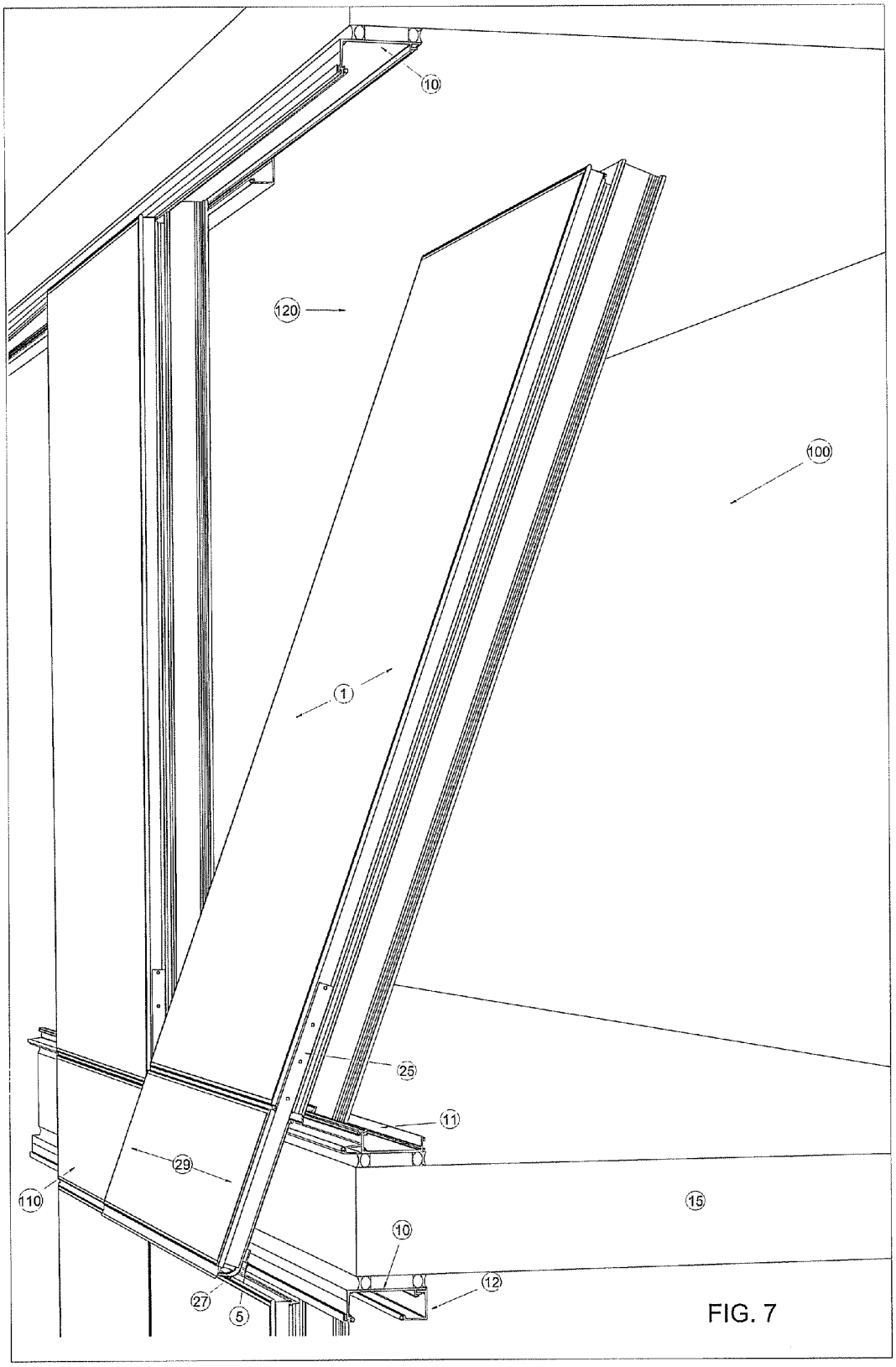
FIG. 7 is a diagram that illustrates a front side perspective view of an exemplary first embodiment of a window wall system with a slab edge cover in an open position and flushly aligned with an adjacent window wall panel during an installation procedure in accordance with an embodiment of the present invention.
Figure 8:
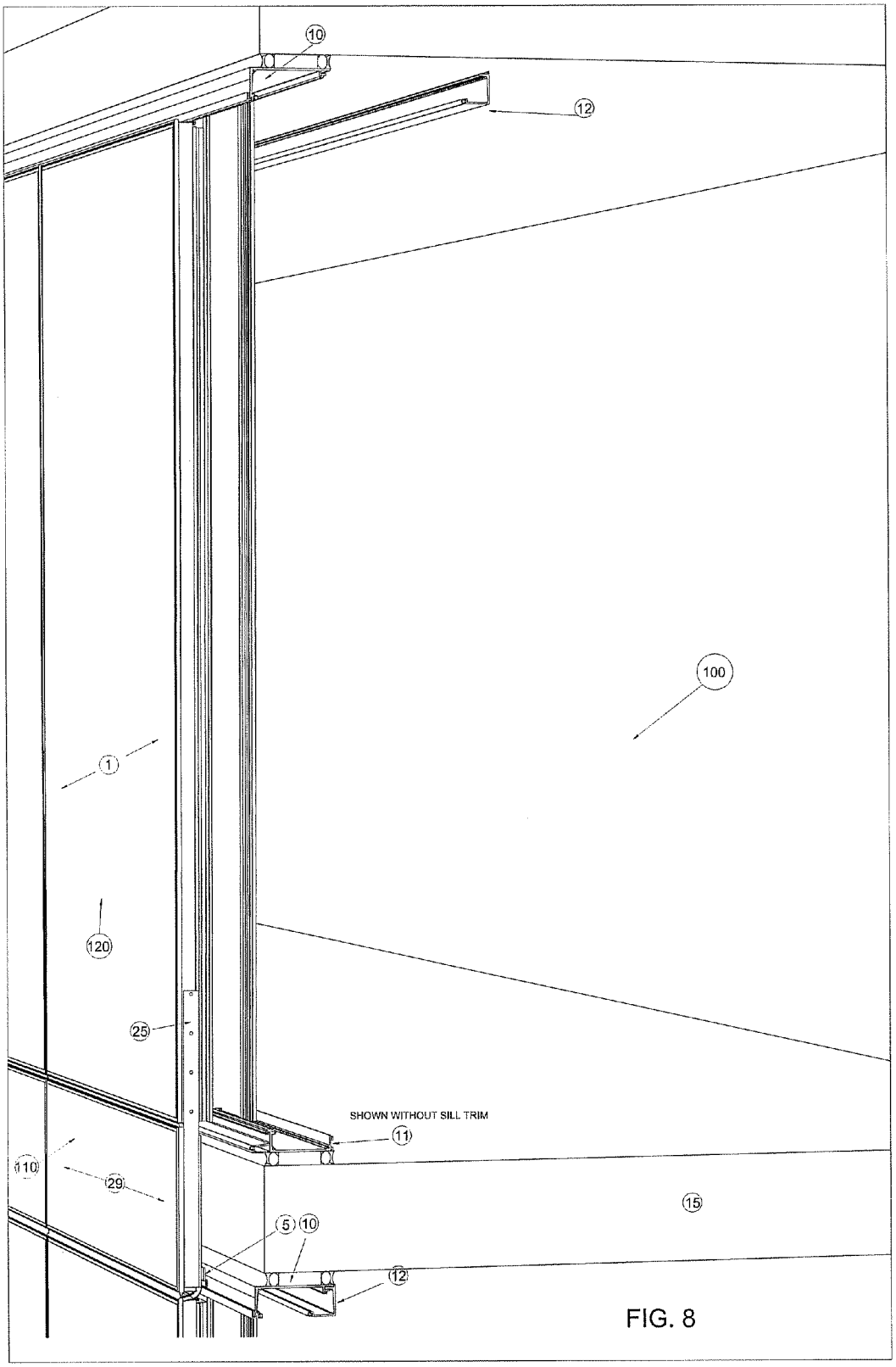
FIG. 8 is a diagram that illustrates a front side perspective view of an exemplary first embodiment of a window wall system with a slab edge cover in an open position and flushly aligned with an adjacent window wall panel during an installation procedure in accordance with an embodiment of the present invention.
Figure 9:
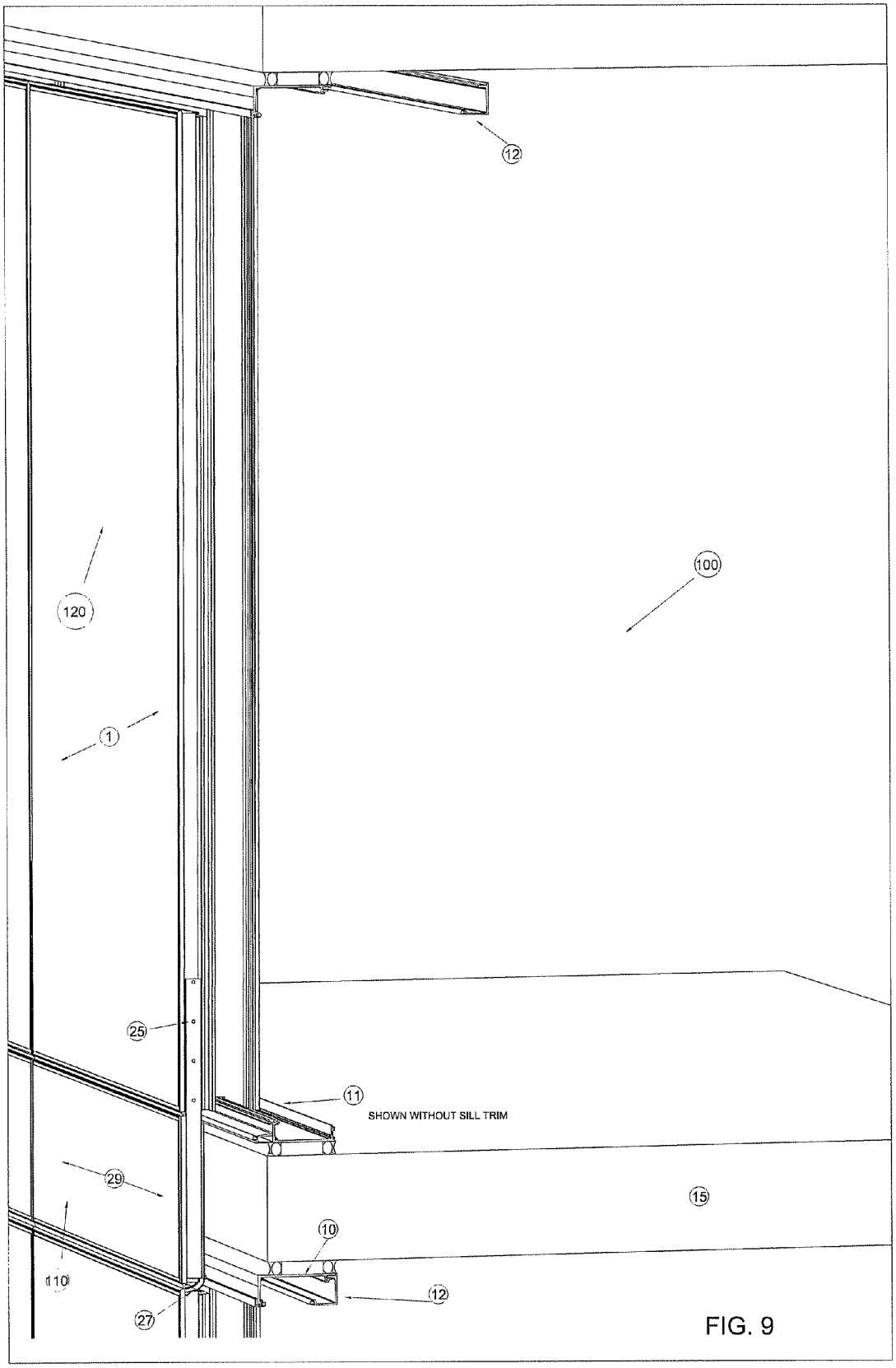
FIG. 9 is a diagram that illustrates a front side perspective view of an exemplary first embodiment of a window wall system with a slab edge cover in a locked position and flushly aligned with an adjacent window wall panel during an installation procedure in accordance with an embodiment of the present invention.

FIGS. 7-8 are diagrams that illustrate a front side perspective view of an exemplary first embodiment of a window wall system 100 with a slab edge cover 110 in an open position and flushly aligned with an adjacent window wall panel 120 during an installation procedure in accordance with an embodiment of the present invention. FIG. 9 is a diagram that illustrates a front side perspective view of an exemplary first embodiment of a window wall system 100 with a slab edge cover 110 in a locked position and flushly aligned with an adjacent window wall panel 120 during an installation procedure in accordance with an embodiment of the present invention.

Referring to FIGS. 7-9, the window wall system 100 comprises a head receptor 10, a sill receptor 11, a window wall panel 120, and a slab edge cover 110 detachably coupled and flushly aligned in a vertical plane with the window wall panel 120. The slab edge cover 110 and window wall panel 120 may each be a four-sided structurally glazed system comprising infill 1, 29, for example. The slab cover infill 29 and panel infill 1 may be insulated glass, stone, metal, wood, or any suitable material. In various embodiments, insulated vision glass can be used for the panel infill 1 and spandrel glass may be used for the slab cover infill 29, for example. The sill receptor 11 and head receptor 10 are securely attached to a slab 15. The sill receptor 11 is configured to receive a panel sill of the window wall panel 120. The head receptor 10 is configured to receive a panel head of a window wall panel 120 and may include a head receptor drive-on 12 for holding the window wall panel in place at the head receptor 10.

The slab edge cover 110 can include a sliding transmission bar clip 5 for detachably coupling the slab edge cover 110 to the head receptor 10. The sliding transmission bar clip 5 is a continuous transmission bar that extends horizontally beyond an edge of the slab cover frame 28 when the slab edge cover 110 is in an open position (i.e., when the slab edge cover 110 is not coupled to the head receptor 10), as illustrated in FIGS. 7-8. The sliding transmission bar clip 5 can lock the slab edge cover 110 to the head receptor 10 by applying a horizontal force towards the slab cover frame 28 to the edge of the sliding transmission bar clip 5 that extends beyond the slab cover frame 28. The horizontal force applied to the sliding transmission bar clip 5 forces the sliding transmission bar clip 5 to slide such that the sliding bar clip 5 couples with the head receptor 10 in a locked position. For example, as illustrated in FIG. 9 the transmission bar clip (not shown) does not extend beyond an edge of the slab cover frame 28 after being slid into a locked position during the installation procedure.

Various embodiments provide that the slab edge cover 110 is detachably coupled to an adjacent window wall panel 120, such as the window wall panel 120 above the slab edge cover 110 as shown in FIGS. 7-9. The slab edge cover 110 can be coupled to the window wall panel 120 prior to installation to provide a more efficient installation process, for example. The slab edge cover 110 is detachable from the window wall panel 120 such that the slab 15, insulation (not shown) between the slab 15 and the slab edge cover 110, and/or components of the window wall system 100 can be accessed for maintenance purposes, among other things. In certain embodiments, a support arm 25 can be attached to the vertical sides of the window wall panel 120 frame and extend vertically to detachably couple with the slab edge cover 110 frame. In various embodiments, the support arm 25 can include a support arm gasket 27. The support arm gaskets 27 of adjacent slab edge covers 110 provide a channel to direct water behind the slab edge covers 110 and out the front of the window wall system 100 between the slab edge cover 110 and the window wall panel 120 below the slab edge cover 110.

Referring to FIG. 7, the window wall panel 120 detachably coupled to the slab edge cover 110 is shown during an installation procedure, where the window wall panel 120 is received at the sill receptor 11. Referring to FIG. 8, the window wall panel 120 detachably coupled to the slab edge cover 110 is tilted outward such that the window wall panel 120 is received at the head receptor 10. The head receptor drive-on 12 can be attached to the head receptor 10 after the window wall panel 120 is received at the head receptor 10 to hold the panel in place at the head receptor 10. The sliding transmission bar clip 5 can receive a horizontal force that slides the sliding transmission bar clip 5 toward the slab edge cover 110 such that the sliding transmission bar clip 5 couples with the head receptor 10 in a locked position, as illustrated in FIG. 9.

The window wall system 100 illustrated in FIGS. 7-9 shares various characteristics with the window wall system 100 illustrated in FIGS. 1-6, as described above.

Figure 10:
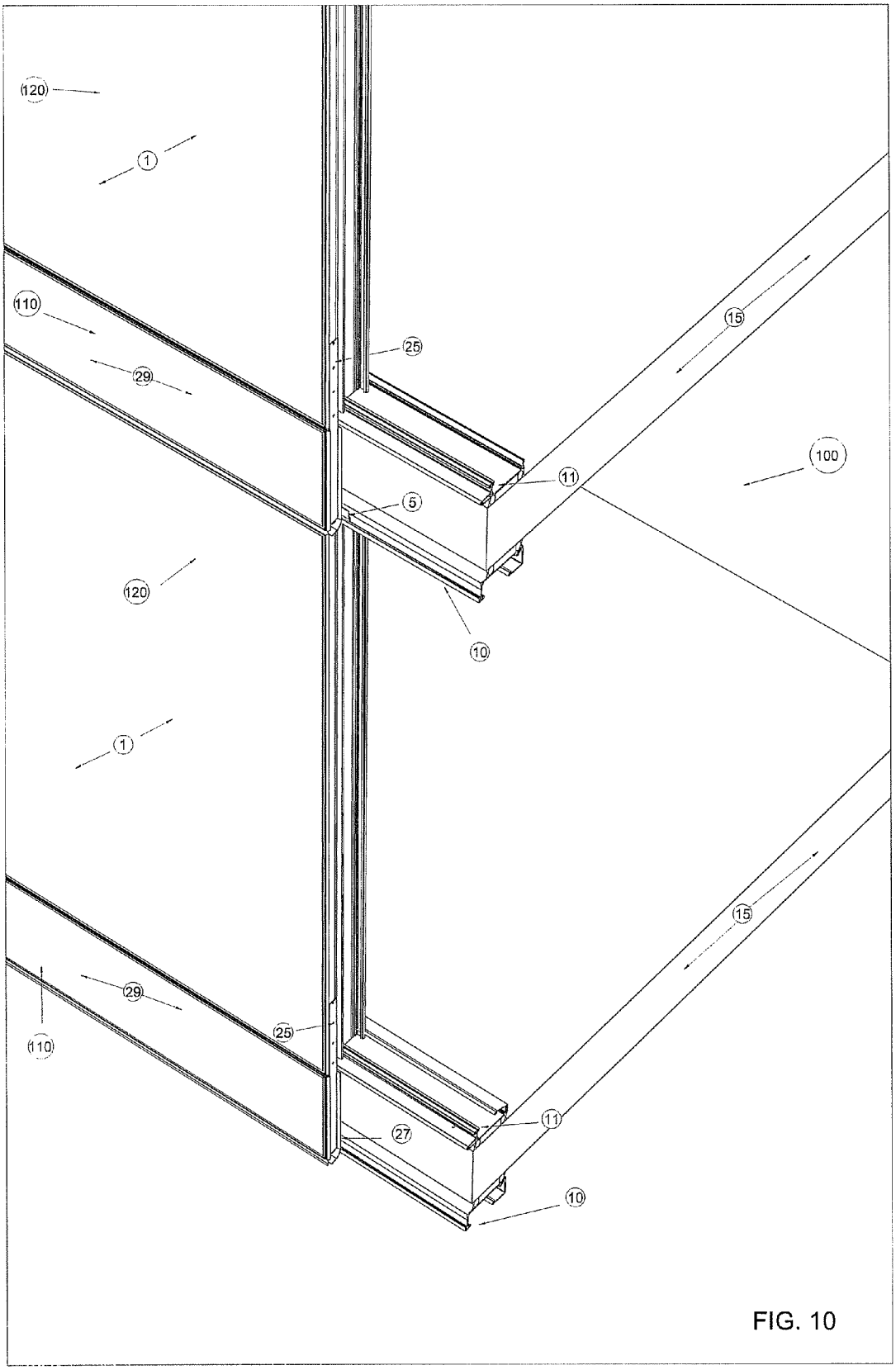
FIG. 10 is a diagram that illustrates a front side perspective view of an exemplary first embodiment of a window wall system with slab edge covers flushly aligned with adjacent window wall panels in open and locked positions in accordance with an embodiment of the present invention.

FIG. 10 is a diagram that illustrates a front side perspective view of an exemplary first embodiment of a window wall system 100 with slab edge covers 110 flushly aligned with adjacent window wall panels 120 in open and locked positions in accordance with an embodiment of the present invention. Referring to FIG. 10, the window wall system 100 comprises head receptors 10, a sill receptors 11, window wall panels 120, and slab edge covers 110 detachably coupled and flushly aligned in a vertical plane with the window wall panels 120. The slab edge covers 110 and window wall panels 120 may each be four-sided structurally glazed systems comprising infill 1, 29, for example. The slab cover infill 29 and panel infill 1 may be insulated glass, stone, metal, wood, or any suitable material. The sill receptors 11 and head receptors 10 are securely attached to slabs 15. The sill receptors 11 are configured to receive a panel sill of an above window wall panel 120. The head receptor 10 is configured to receive a panel head of a below window wall panel 120.

In various embodiments, the slab edge cover 110 can include a sliding transmission bar clip 5 for detachably coupling the slab edge cover 110 to the head receptor 10. The sliding transmission bar clip 5 is a continuous transmission bar that extends horizontally beyond an edge of the slab cover frame 28 when the slab edge cover 110 is in an open position (i.e., when the slab edge cover 110 is not coupled to the head receptor 10), as illustrated at the upper slab edge cover 110 in FIG. 10. The sliding transmission bar clip 5 can lock the slab edge cover 110 to the head receptor 10 by applying a horizontal force towards the slab cover frame 28 to the edge of the sliding transmission bar clip 5 that extends beyond the slab cover frame 28. The horizontal force applied to the sliding transmission bar clip 5 forces the sliding transmission bar clip 5 to slide such that the sliding bar clip 5 couples with the head receptor 10. For example, the transmission bar clip 5 of the lower slab edge cover 110 illustrated in FIG. 10 is not shown because it does not extend beyond an edge of the slab cover frame 28 after being slid into a locked position.

Certain embodiments provide a support arm 25 attached to the vertical sides of the window wall panel 120 frame and extending vertically to detachably couple with the slab edge cover 110 frame. In various embodiments, the support arm 25 can include a support arm gasket 27. The support arm gaskets 27 of adjacent slab edge covers 110 provide a channel to direct water behind the slab edge covers 110 and out the front of the window wall system 100 between the slab edge cover 110 and the window wall panel 120 below the slab edge cover 110.

The window wall system 100 illustrated in FIG. 10 shares various characteristics with the window wall system 100 illustrated in FIGS. 1-9, as described above.

Figure 12:
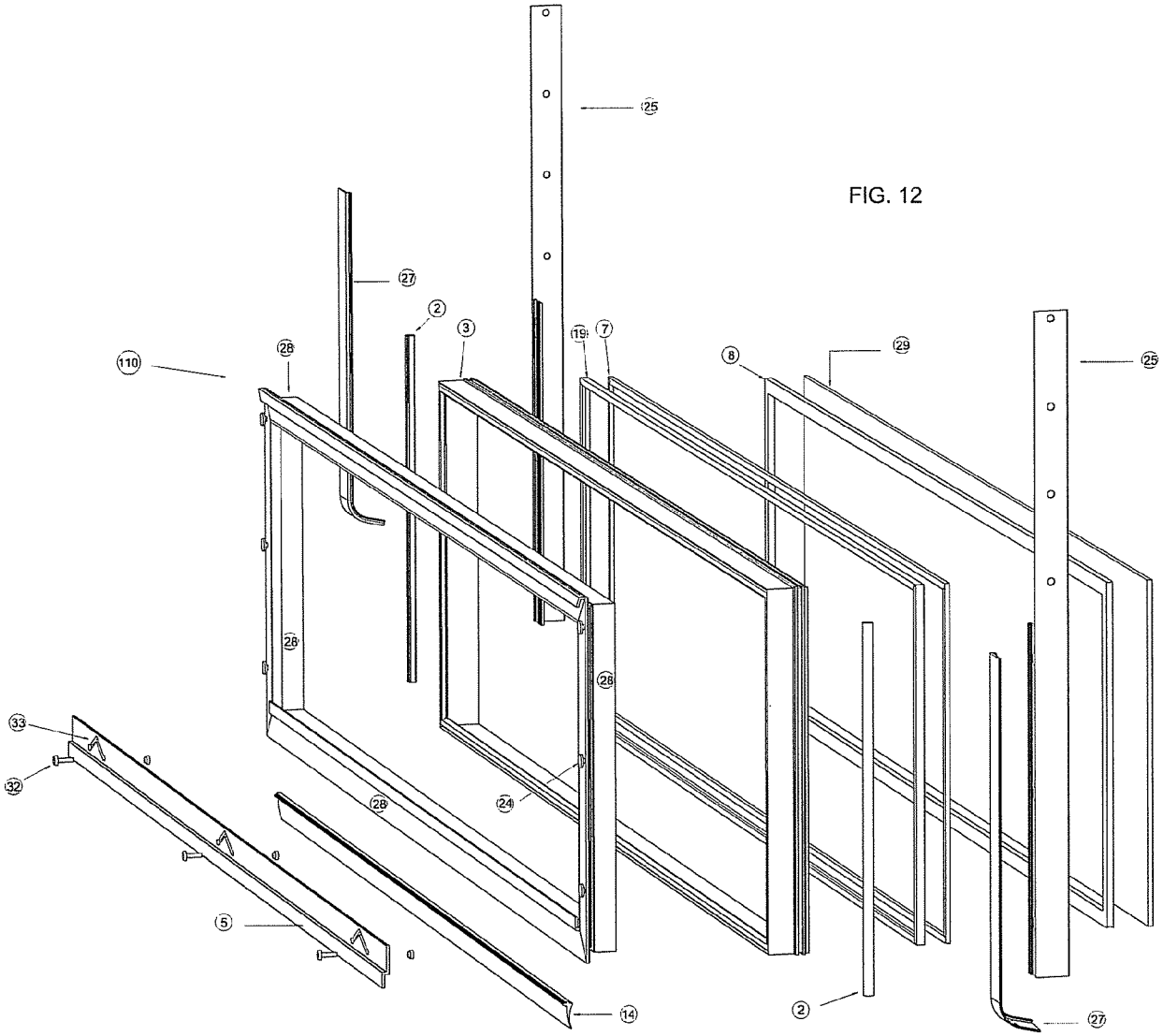
FIG. 12 is a diagram that illustrates an exploded side perspective view of an exemplary first embodiment of a slab edge cover with a support arms in accordance with an embodiment of the present invention.

FIGS. 11-12 are diagrams that illustrate exploded front and side perspective views of an exemplary first embodiment of a slab edge cover 120 with support arms 25 in accordance with an embodiment of the present invention. Referring to FIGS. 11-12, the slab edge cover 110 may include a slab cover frame 28, infill 29, and a sliding transmission bar clip 5, among other things. The slab edge cover infill 29 can be secured within the slab cover frame 28, and glazing beading 3 may be provided to protect the cover infill 29. A wiper gasket 14 can be attached to the base of the glazing beading 3 to prevent water from entering the window wall system 100. Weather seals 7 may be provided between the glazing beading 3 and the infill 29 to provide a barrier to water, for example. Foam backer rod 19 may be used with the weather seal 7 to prevent seepage of the weather seal 7 during application. In various embodiments, gaskets 2 may be provided between the glazing beading 3 of horizontally adjacent slab edge covers 110 to prevent air and water infiltration.

The sliding transmission bar clip 5 is a continuous transmission bar comprising slots 33 for receiving a screw 32 to slidably attach the sliding transmission bar clip 5 to the slab edge cover frame 28. In certain embodiments, the sliding transmission bar clip 5 can extend horizontally beyond an edge of the slab cover frame 28 when the slab edge cover 110 is in an open position. The sliding transmission bar clip 5 can lock the slab edge cover 110 to a head receptor (not shown) by applying a horizontal force towards the slab cover frame 28 to the edge of the sliding transmission bar clip 5 that extends beyond the slab cover frame 28. The horizontal force applied to the sliding transmission bar clip 5 forces the sliding transmission bar clip 5 to slide, as guided by slots 33, such that the sliding bar clip 5 couples with the head receptor (not shown).

Still referring to FIGS. 11-12, the vertical sides of the slab cover frame 28 can include hanging studs 24 for detachably coupling to clip connections 26 of support arms 25 that extend vertically above the slab edge cover 110 and attach to the vertical sides of an above window wall panel frame (not shown). The support arms 25 detach from the slab edge cover frame 28 at the clip connections 26 by lifting the slab edge cover 110 upward (e.g., toward the top of a building) and pulling the slab edge cover 110 outward (e.g., away from the building).

The slab edge cover 110 illustrated in FIGS. 11-12 shares various characteristics with the slab edge cover 110 illustrated in FIGS. 1-10, as described above.

Figure 13:
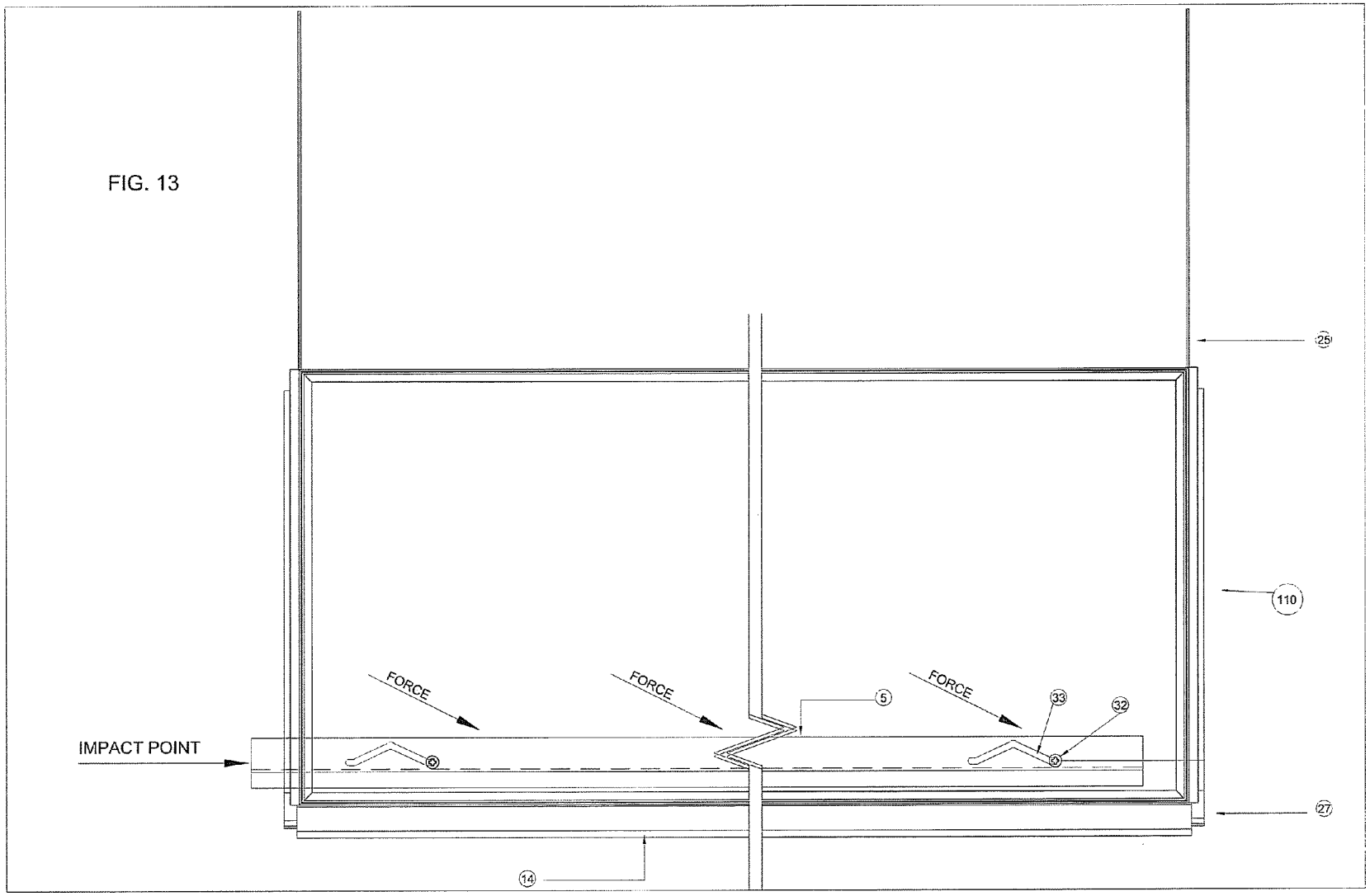
FIG. 13 is a diagram that illustrates a rear view of an exemplary first embodiment of a slab edge cover in an open position in accordance with an embodiment of the present invention.
Figure 14:
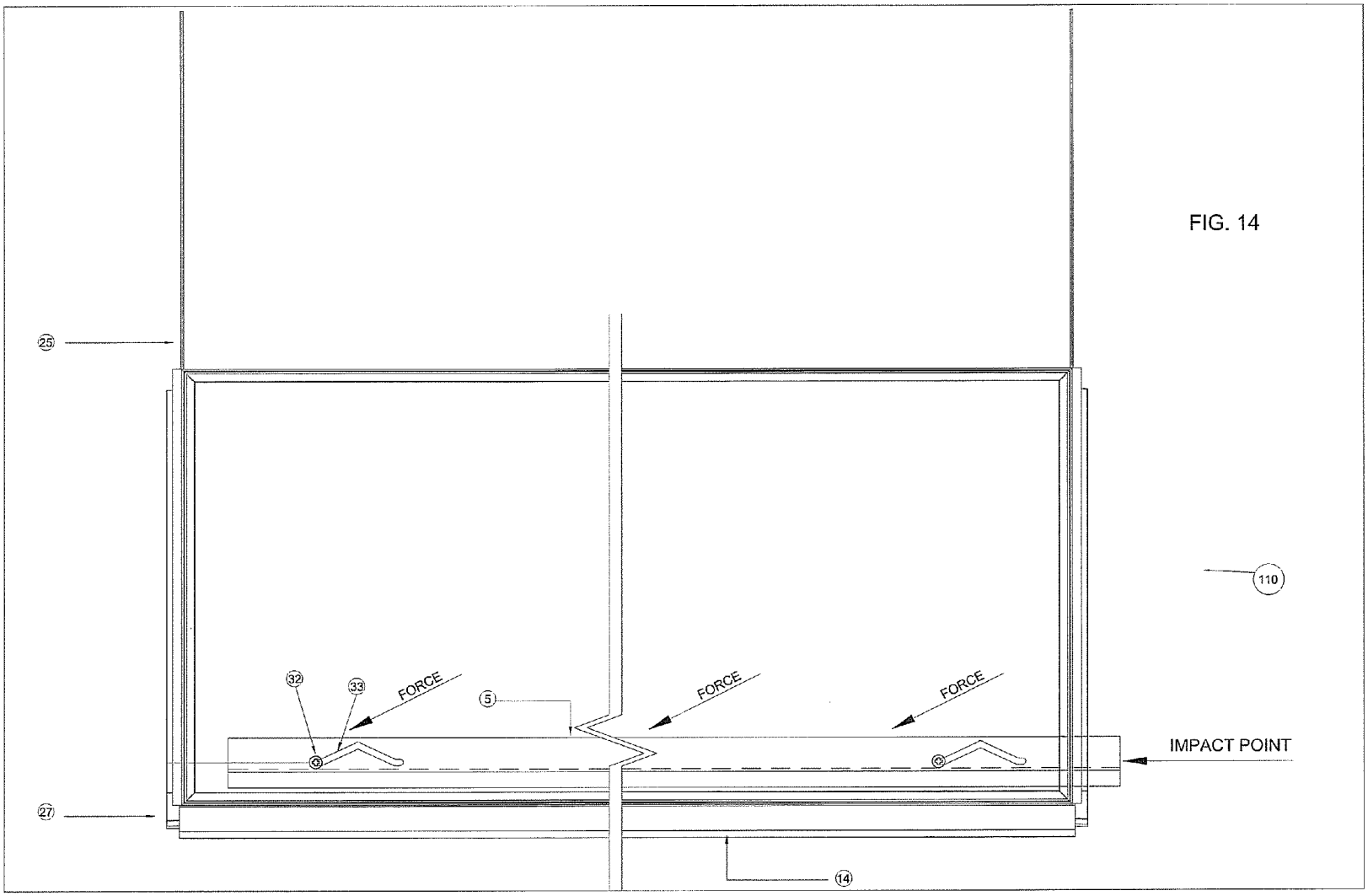
FIG. 14 is a diagram that illustrates a rear view of an exemplary first embodiment of a slab edge cover in an open position in accordance with an embodiment of the present invention.
Figure 15:
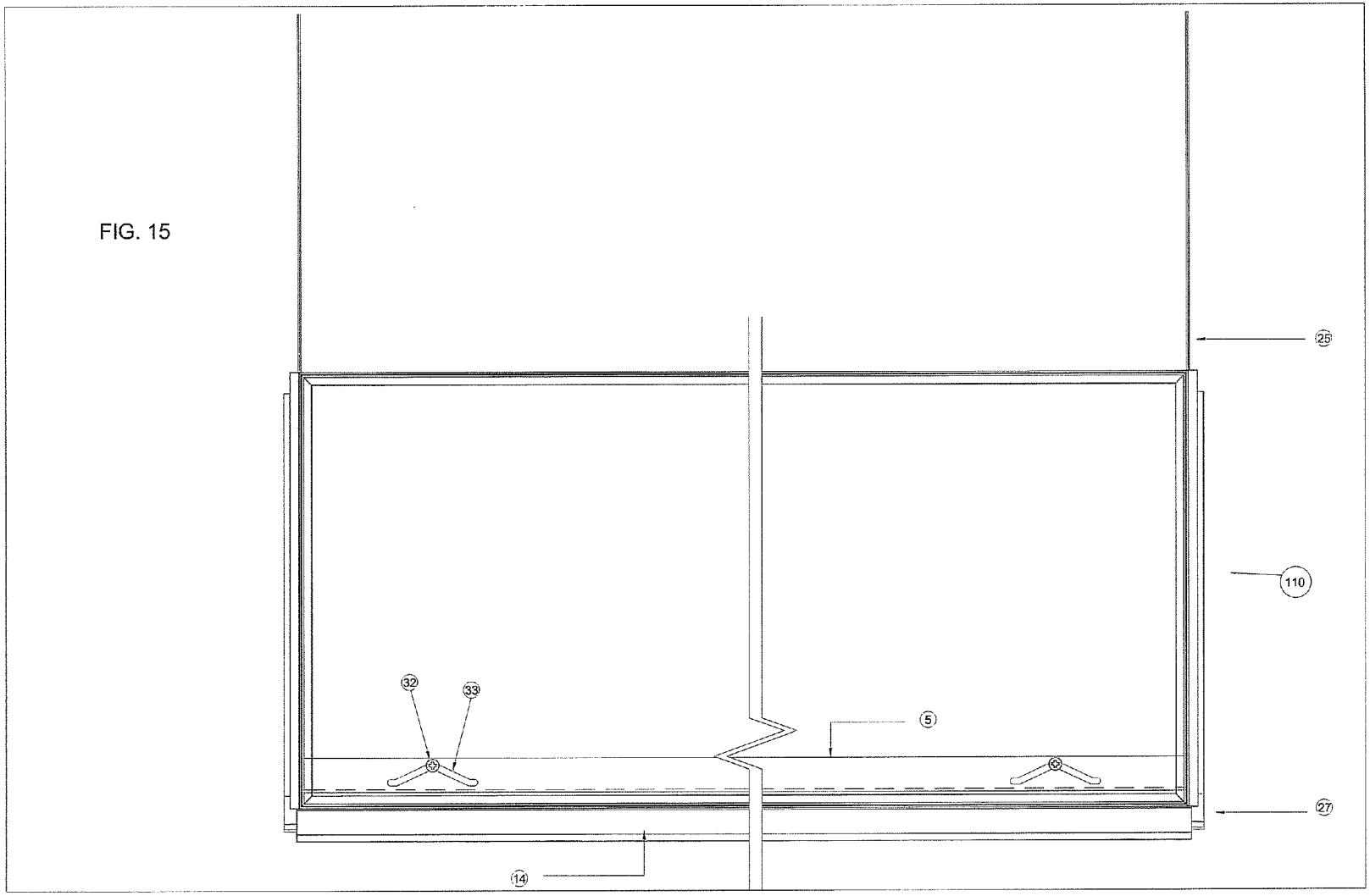
FIG. 15 is a diagram that illustrates a rear view of an exemplary first embodiment of a slab edge cover in a locked position in accordance with an embodiment of the present invention.

FIGS. 13-14 are diagrams that illustrate rear views of an exemplary first embodiment of a slab edge cover 110 in an open position in accordance with an embodiment of the present invention. FIG. 15 is a diagram that illustrates a rear view of an exemplary first embodiment of a slab edge cover 110 in a locked position in accordance with an embodiment of the present invention. Referring to FIGS. 13-15, a slab edge cover 110 comprises a sliding transmission bar clip 5, a wiper gasket 14, a support arm 25, and a support arm gasket 27, among other things. The wiper gasket 14 can be attached to the base of the slab edge cover 110 to prevent water from entering the window wall system. The support arms 25 detachably couple to the vertical sides of the slab edge cover 110 frame and extend vertically to attach to an above window wall panel frame (not shown). The support arms 25 can each include a support arm gasket 27 for directing water behind the slab edge cover 110 and out the front of the window wall system between the slab edge cover 110 and a window wall panel (not shown) below the slab edge cover 110.

The sliding transmission bar clip 5 is a mechanism for detachably coupling the slab edge cover 110 to a head receptor (not shown). In various embodiments, the sliding transmission bar clip 5 is a continuous transmission bar comprising slots 33 for receiving a screw 32 to slidably attach the sliding transmission bar clip 5 to the slab edge cover frame 28, for example. In certain embodiments, the sliding transmission bar clip 5 can extend horizontally beyond an edge of the slab cover frame 28 when the slab edge cover 110 is in an open position (i.e., when the slab edge cover 110 is not coupled to the head receptor), as illustrated in FIGS. 13-14. The sliding transmission bar clip 5 can lock the slab edge cover 110 to the head receptor 10 by applying a horizontal force at an impact point at the edge of the sliding transmission bar clip 5 that extends beyond the slab cover frame 28. The horizontal force applied to the sliding transmission bar clip 5 forces the sliding transmission bar clip 5 to slide, as guided by slots 33, such that the sliding bar clip 5 slides into a locked position behind the slab edge cover 110, as illustrated in FIG. 15.

The slab edge cover 110 illustrated in FIGS. 13-15 shares various characteristics with the slab edge cover 110 illustrated in FIGS. 1-14, as described above.

Figure 16:
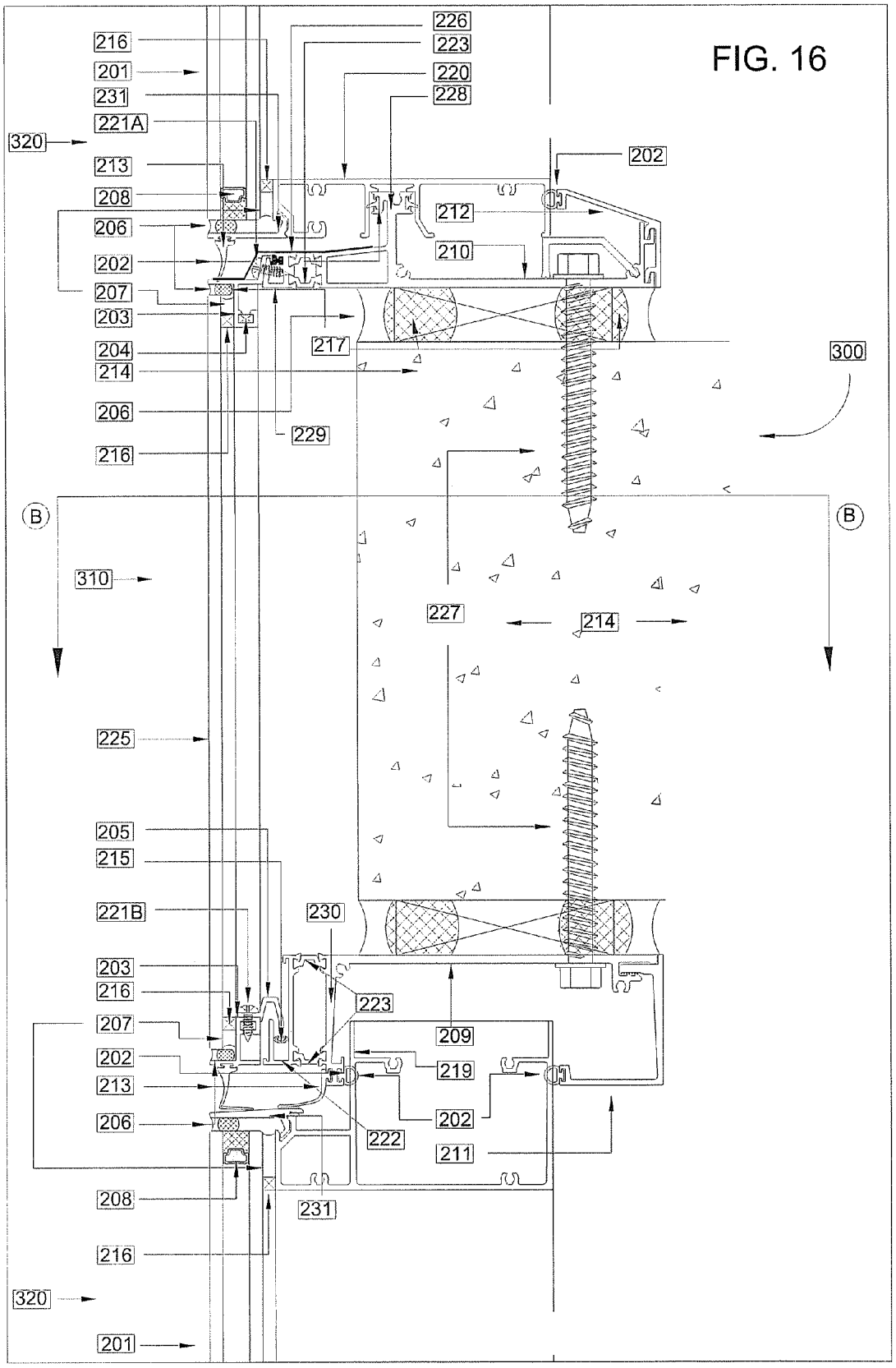
FIG. 16 is a diagram that illustrates a cross-sectional view of an exemplary second embodiment of a window wall system with a slab edge cover flushly aligned with adjacent window wall panels in accordance with an embodiment of the present invention.

FIG. 16 is a diagram that illustrates a cross-sectional view of an exemplary second embodiment of a window wall system 300 with a slab edge cover 310 flushly aligned with adjacent window wall panels 320 in accordance with an embodiment of the present invention. Referring to FIG. 16, the window wall system 300 comprises a head receptor 209, a sill receptor 210, window wall panels 320, and a slab edge cover 310 flushly aligned in a vertical plane with the window wall panels 320 and detachably coupled to the receptors 209, 210. The sill receptor 210 and head receptor 209 are securely attached to a slab 214 using anchors 227, embeds, welding, or any suitable coupling mechanism. The slab 214 can be concrete, wood, a metal tube, metal I-beam, or any suitable slab-type. In various embodiments, backer rod 217 and a weather seal 206, such as silicone caulk, can be applied between the receptors 209, 210 and the slab 214 to provide a seal against air and water infiltration.

Certain embodiments provide that the head receptor 209 and/or the sill receptor 210 are extended such that the head receptor 209 and/or the sill receptor 210 are coupled to the slab 214 at an increased distance from the edge of the slab 214. Coupling the head receptor 209 and/or the sill receptor 210 at an increased distance from the edge of the slab 214 provides greater support for the window wall panels 320 and slab edge covers 310, and allows the attachment mechanism 227 that couples the head receptor 209 and/or the sill receptor 210 to the slab 214 to be accessible, for example. As an example, various embodiments provide that the attachment mechanism 227 that mounts the head receptor 209 and/or sill receptor 210 to the slab 214 is behind, or farther from the edge of the slab 214 than, an installed panel head 219 and/or sill 220, respectively, as illustrated in FIG. 16. More specifically, a horizontal distance from the edge of the slab 214 to a center of the affixed attachment mechanism 227 of the head receptor 209 and/or sill receptor 210 is greater than a horizontal distance from the edge of the slab 214 to the building interior edge of an installed panel head 219 and/or panel sill 220.

The sill receptor 210 can include a detachably coupled sill trim 212 for providing access to the anchor 227 or any suitable attachment mechanism. The sill receptor 210 is configured to receive a panel sill 220 of a window wall panel 320 at an upward projection 228, commonly referred to as a "chicken head." The panel sill 220 dead loads on the upward projection 228 to provide a press or wedge fit, for example. The upward projection 228 and the sill trim 212 may include gaskets 202 to provide a seal against air and water infiltration. The gaskets 202 can be ethylene propylene diene monomer (EPDM), silicone, or any suitable material, for example. In certain embodiments, the sill receptor 210 can include one or more isolation bars 223 for improving thermal performance by providing a thermal break in the sill receptor 210, which may be aluminum or other suitable materials, for example. The isolation bars 223 may be polyamide or any suitable material, for example.

In various embodiments, the sill receptor 210 includes a sill clip 229 for detachably coupling with glazing beading/slab cover frame 203 using a clip screw 221A. The sill clip 229 may be a continuous clip that substantially spans the length of the sill receptor 210, for example. The clip screw 221A fastens the glazing beading/slab cover frame 203 to the sill clip 229 to assist in securing the slab edge cover 310 to the sill receptor 210. In certain embodiments, a silicone sheet 226 can be applied at the sill receptor 210 and/or the glazing bead/slab cover frame 203 adjacent to the clip screw 221A to direct water out of the window wall system 300 between the slab edge cover 310 and a window wall panel 320 above the slab edge cover 310. The silicone sheet 226 can be a continuous sheet that substantially spans the length of the sill receptor 210 and/or glazing beading/slab edge cover 203, or can be applied at joints of the slab edge cover 310, for example. The silicone sheet 226 may be applied using silicone caulk or any suitable adhesive underneath and/or around the edges of the silicone sheet 226, for example.

The slab edge cover 310 and window wall panels 320 may be a four-sided structurally glazed system where the slab cover infill 225 is coupled to the glazing beading/slab cover frame 203, and the wall panel infill 1 is coupled to the panel head 219 and panel sill 220, by structural caulk 207. The slab cover infill 225 and panel infill 201 may be insulated glass, stone, metal, wood, or any suitable material. In various embodiments, insulated vision glass can be used for the panel infill 201 and spandrel glass may be used for the slab cover infill 225, for example. The structural caulk 207 can be silicone or any suitable material. In various embodiments, glazing tape 216 can be used with the structural caulk 207 to prevent seepage of the structural caulk during application.

The window wall panels 320 can include panel infill 201, glazing beading 231, a panel head 219, a panel sill 220, a wiper gasket 213, and vertical mullions (not shown). The window wall panels 320 are secured at a bottom side of slab 214 at a head receptor 209 that receives and secures the panel head 219. The window wall panels 320 are secured at a top side of slab 214 at a sill receptor 210 that receives and secures the panel sill 220. The window wall panels 320 are coupled to horizontally adjacent window wall panels 320 at vertical mullions (not shown). In various embodiments, glazing beading 231 may be provided to protect the panel infill 201. A weather seal 206 may be provided between the glazing beading 203 and the panel infill 201 to provide a barrier to water, for example. The weather seal 206 can be silicone, polyurethane, or any suitable material. In certain embodiments, a foam backer rod 217 may be used with the weather seal 206 to prevent seepage of the weather seal 206 during application. A wiper gasket 213 can be attached to the base of the glazing beading 231 to prevent water from entering the window wall system 300. The wiper gasket 213 may be ethylene propylene diene monomer (EPDM) or any suitable material, for example. In various embodiments, the window wall panel 320 may be an insulated glass unit that includes insulated glass spacer bars 208 between the panes of glass 201.

The slab edge cover 310 may include glazing beading/slab cover frame 203, infill 225, and a panel clip 205, among other things. The slab edge cover infill 225 can be secured within glazing beading/slab cover frame 203. A wiper gasket 213 can be attached to the base of the glazing beading/slab cover frame 203 to prevent water from entering the window wall system 300. The wiper gasket 213 may be ethylene propylene diene monomer (EPDM) or any suitable material, for example. Glass setting blocks 218 may be provided between the infill 225 edge and the glazing beading/slab cover frame 203 to act as a spacer. The glass setting blocks 218 can be ethylene propylene diene monomer (EPDM) or any suitable material, for example. Weather seals 206 may be provided between the glazing beading/slab cover frame 203 and the infill 225 to provide a barrier to water, for example. The weather seals 206 can be silicone, polyurethane, or any suitable material. In certain embodiments, a foam backer rod 217 may be used with the weather seal 206 to prevent seepage of the weather seal 206 during application. The glazing beading/slab cover frame 203 can include pockets at each corner of the glazing beading/slab cover frame 203 for receiving L-shaped corner keys 204. The L-shaped corner keys tie the vertical portions of the slab cover frame 203 to the horizontal portions of the slab cover frame 203. The corner keys 204 may be aluminum or any suitable material, for example.

The panel clip 205 is a mechanism for detachably coupling the slab edge cover 310 to the head receptor 209. In various embodiments, one or more panel clips 205 are affixed to the glazing beading/slab cover frame 203 by clip screw(s) 221B. The one or more panel clips 205 detachably couple with the head receptor at clip connection 222. The clip connection 222 may be a continuous clip that substantially spans the length of the head receptor 209 or can be non-continuous clip(s) positioned to correspond with the one or more panel clips 205 of the slab edge cover 310, for example. In certain embodiments, the panel clip 205 and/or the clip connection 222 may include anti-friction pad(s) 215 for allowing the panel clip 205 to easily slide into the clip connection 222 while preventing damage to the panel clip 205 and the clip connection 222, for example. The anti-friction pad(s) 215 can be nylon or any suitable anti-friction material, for example. The slab edge cover 310 is detachable from the head receptor 209 at clip connection 222, and from the sill receptor 210 at sill clip 229 such that the slab 214, insulation (not shown) between the slab 214 and the slab edge cover 310, and/or components of the window wall system 300 can be accessed for maintenance purposes, among other things.

The head receptor 209 can include a head receptor drive-on 211, a head receptor arm 230, a clip connection 222, a wiper gasket 213, and isolation bar(s) 223. The head receptor drive-on 211 is attached to the head receptor 209 after the head receptor 209 is securely attached to the slab 214, and a panel head 219 of a window wall panel 320 is received at the head receptor 209. The head receptor drive-on 211, when attached to the head receptor 209, compresses the panel head 219 against the head receptor arm 230 to hold the window wall panel 320 in place at the head receptor 209. The compression fitting of the panel head 219 between the head receptor drive-on 211 and the head receptor arm 230 may include gaskets 202 to provide a seal against air and water infiltration. The gaskets 202 can be ethylene propylene diene monomer (EPDM), silicone, or any suitable material, for example.

In certain embodiments, the head receptor 209 can include one or more isolation bars 223 for improving thermal performance by providing a thermal break in the head receptor 209, which may be aluminum or other suitable materials, for example. The isolation bars 223 may be polyamide or any suitable material, for example. In various embodiments, the head receptor 209 may include a clip connection 222. The clip connection 222 is configured to receive the panel clip(s) 205 when the slab edge cover 310 is installed or reattached, for example. In various embodiments, the head receptor 209 may include a wiper gasket 213 attached to the head receptor arm 230 to direct water that has entered the window wall system 300 out the front of the window wall system 300 between the slab edge cover 310 and the window wall panel 320 below the slab edge cover 310. The wiper gasket 213 may be ethylene propylene diene monomer (EPDM) or any suitable material, for example. In certain embodiments, the clip connection 222 and/or the panel clip 205 may include anti-friction pad(s) 215 for allowing the panel clip 205 to easily slide into the clip connection 222 while preventing damage to the panel clip 205 and the clip connection 222, for example. The anti-friction pad(s) 215 can be nylon or any suitable anti-friction material, for example.

Figure 17:
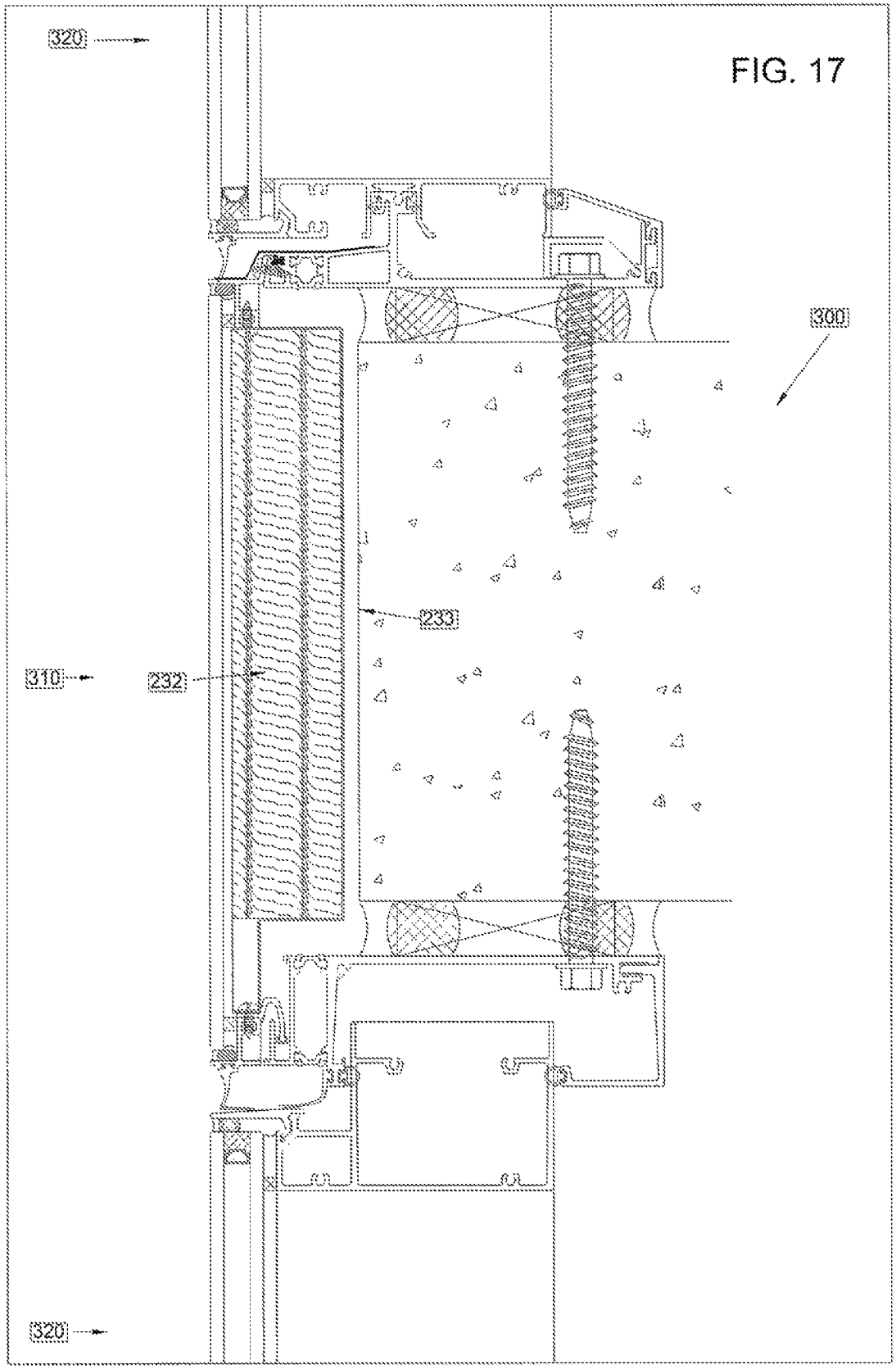
FIG. 17 is a diagram that illustrates a cross-sectional view of an exemplary second embodiment of a window wall system with a slab edge cover that includes insulation and is flushly aligned with adjacent window wall panels in accordance with an embodiment of the present invention.

In certain embodiments, the slab edge cover 310 can include a backpan (not shown) for holding insulation (not shown), such as mineral wool insulation, vacuum insulated panels, or any suitable insulation for improving the thermal performance of the window wall system 300, as illustrated in FIG. 17, for example. Certain embodiments provide that slab cover infill 225 may be vision glass and a backpan can be painted on the interior to provide a shadow box appearance. In various embodiments, insulation may be attached to the edge of the slab 214. In certain embodiments, the window panel infill 201 and/or the slab edge cover infill 225 can be vacuum insulated glass.

Various embodiments provide that the slab edge cover 310 is flushly aligned with adjacent window wall panels 320. More specifically, the exterior surface of the infill 201 of the window wall panels 320 are aligned with the exterior surface of the infill 225 of the slab edge covers 310 such that the exterior surface of the window wall system 300 is substantially without protrusions.

FIG. 17 is a diagram that illustrates a cross-sectional view of an exemplary second embodiment of a window wall system 300 with a slab edge cover 310 that includes insulation 232 and is flushly aligned with adjacent window wall panels 320 in accordance with an embodiment of the present invention. The window wall system 300 illustrated in FIG. 17 shares various characteristics with the window wall system 300 illustrated in FIG. 16, as described above. Referring to FIG. 17, the slab edge cover 310 can include a backpan 233 for holding insulation 232, such as mineral wool insulation, vacuum insulated panels, or any suitable insulation for improving the thermal performance of the window wall system 300. The backpan 233 can detachably couple with the glazing beading/slab cover frame 203, for example.

Figure 18:
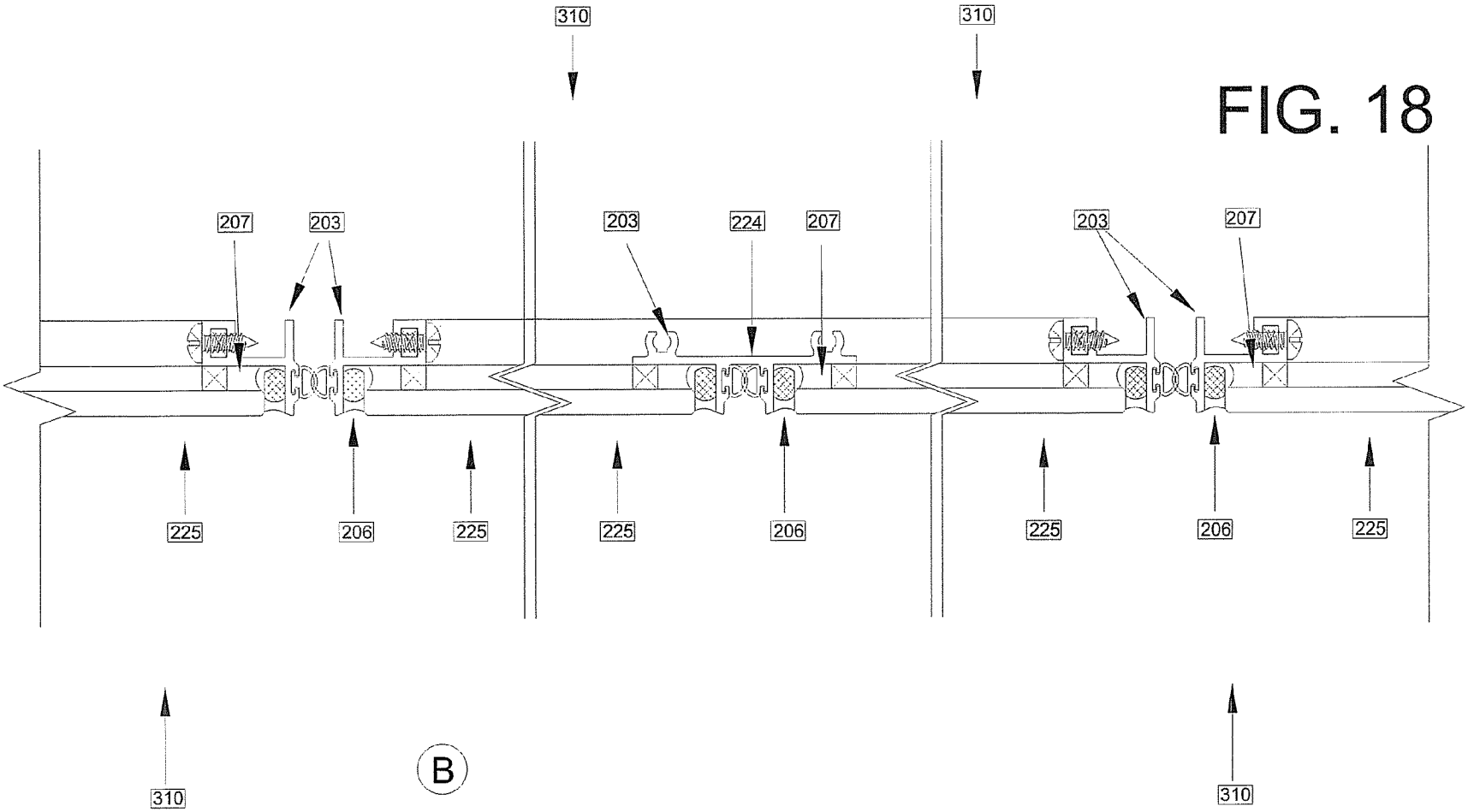
FIG. 18 is a diagram that illustrates a top plan view of an exemplary second embodiment of a window wall system with multiple slab edge covers combined in a frame in accordance with an embodiment of the present invention.
Figure 26:
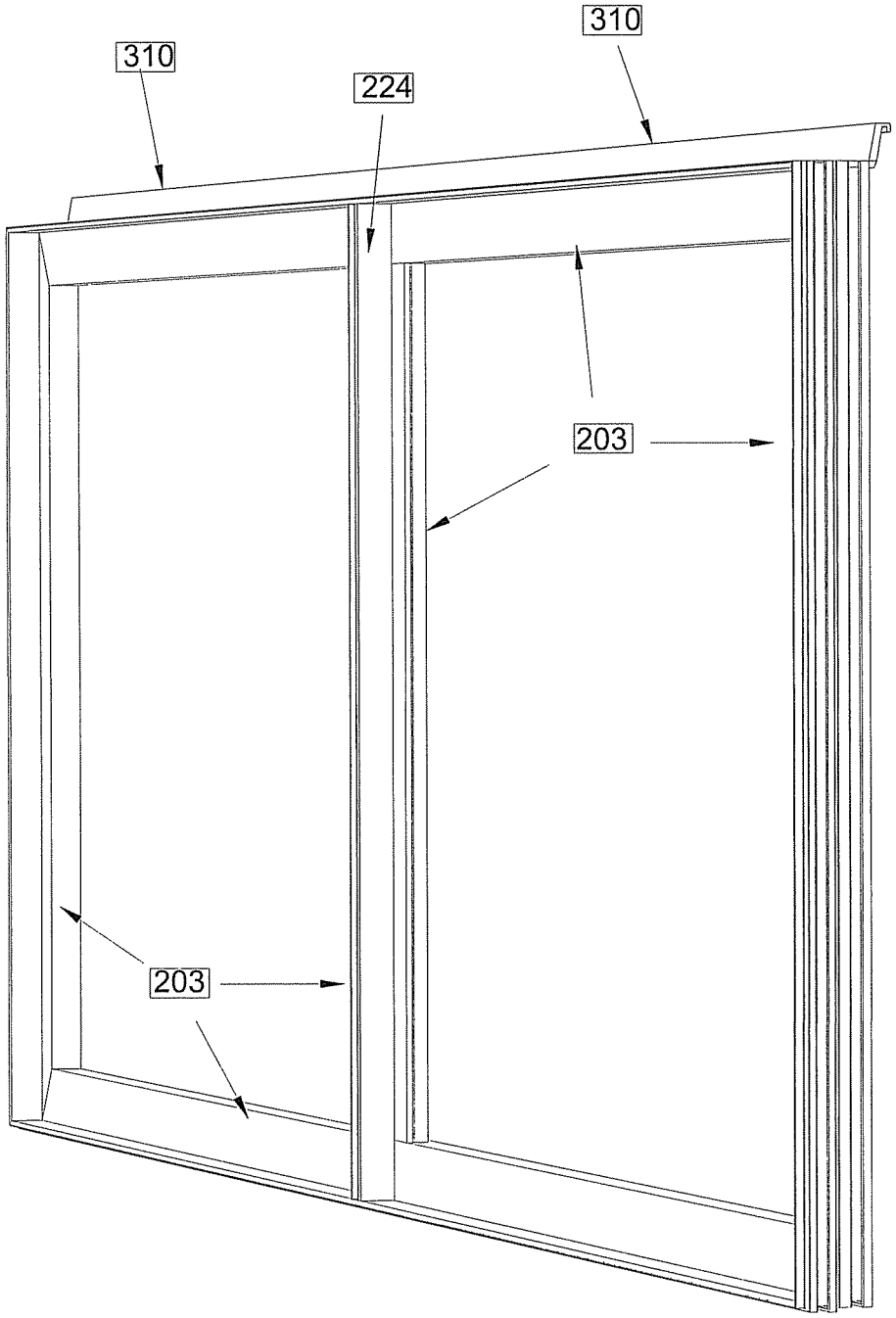
FIG. 26 is a diagram that illustrates a front perspective view of an exemplary second embodiment of a window wall system with multiple slab edge covers combined in a frame in accordance with an embodiment of the present invention.

FIG. 18 is a diagram that illustrates a top plan view of an exemplary second embodiment of a window wall system 300 with multiple slab edge covers 310 combined in a frame 203 in accordance with an embodiment of the present invention. FIG. 26 is a diagram that illustrates a front perspective view of an exemplary second embodiment of a window wall system 300 with multiple slab edge covers 310 combined in a frame 203 in accordance with an embodiment of the present invention. Referring to FIGS. 18 and 26, multiple slab edge covers 310 can be included in a four-sided structurally glazed system where slab cover infill 225 of each of the slab edge covers 310 is coupled to the glazing beading/slab cover frame 203 by structural caulk 207. The multiple slab edge covers 310 may include glazing beading/slab cover frame 203, infill 225, and an intermediate frame vertical 224, among other things. The slab edge cover infill 225 of the multiple slab edge covers 310 can be secured within glazing beading/slab cover frame 203. Weather seals 206 may be provided between the glazing beading/slab cover frame 203 and the infill 225 to provide a barrier to water, for example. The intermediate frame vertical 224 can be a vertical die used to join the slab edge covers 310 together within the glazing beading/slab cover frame 203, for example. In various embodiments, combining multiple slab edge covers 310 in a frame 203 can reduce installation time, among other things.

The slab cover frames 310 illustrated in FIGS. 18 and 26 shares various characteristics with the slab cover frame 310 illustrated in FIGS. 16-17, as described above.

Figure 19:
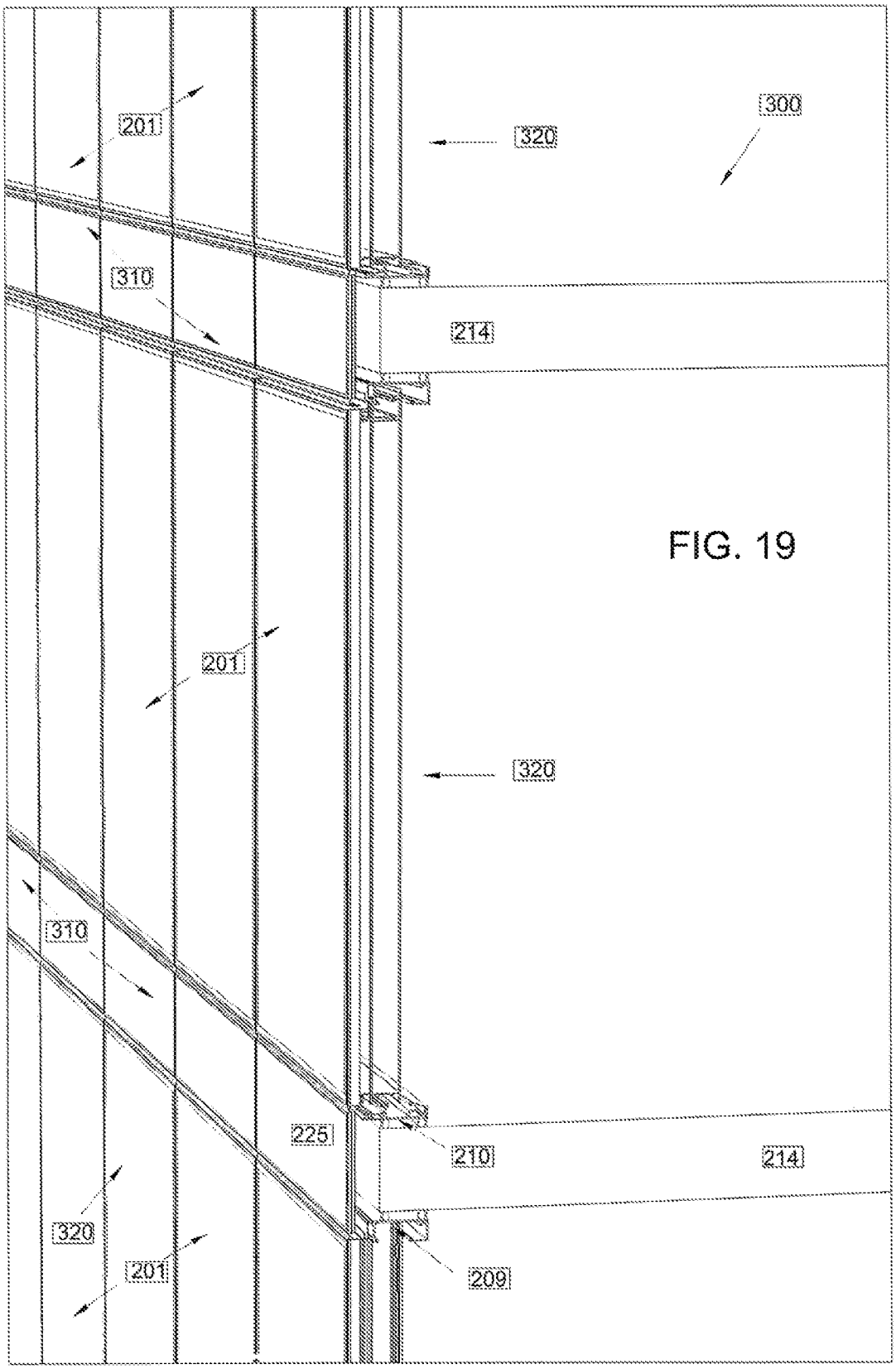
FIG. 19 is a diagram that illustrates a front side perspective view of an exemplary second embodiment of a window wall system with slab edge covers flushly aligned with adjacent window wall panels in accordance with an embodiment of the present invention.
Figure 20:
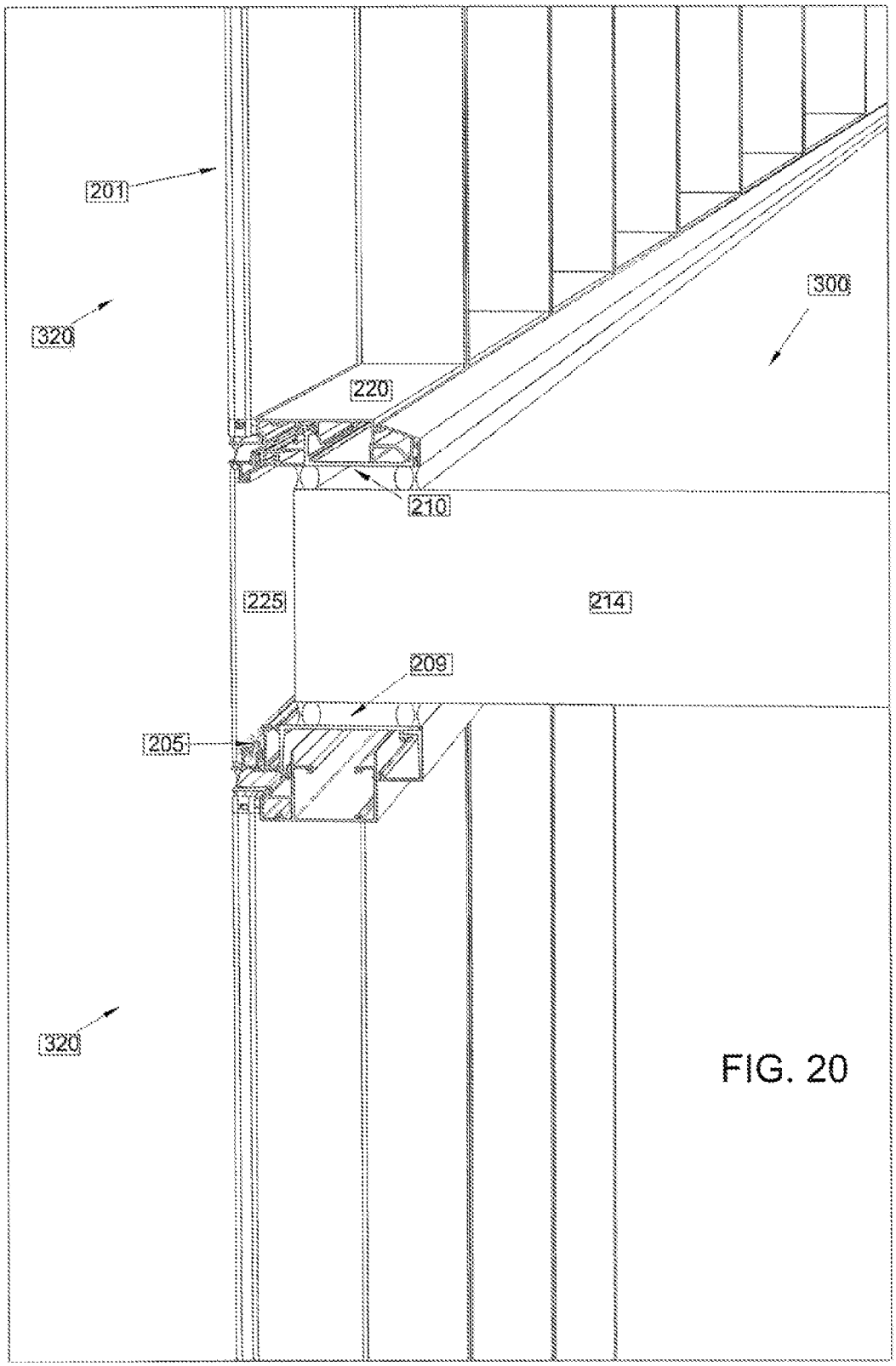
FIG. 20 is a diagram that illustrates a rear side perspective view of an exemplary second embodiment of a window wall system with slab edge covers flushly aligned with adjacent window wall panels in accordance with an embodiment of the present invention.
Figure 21:
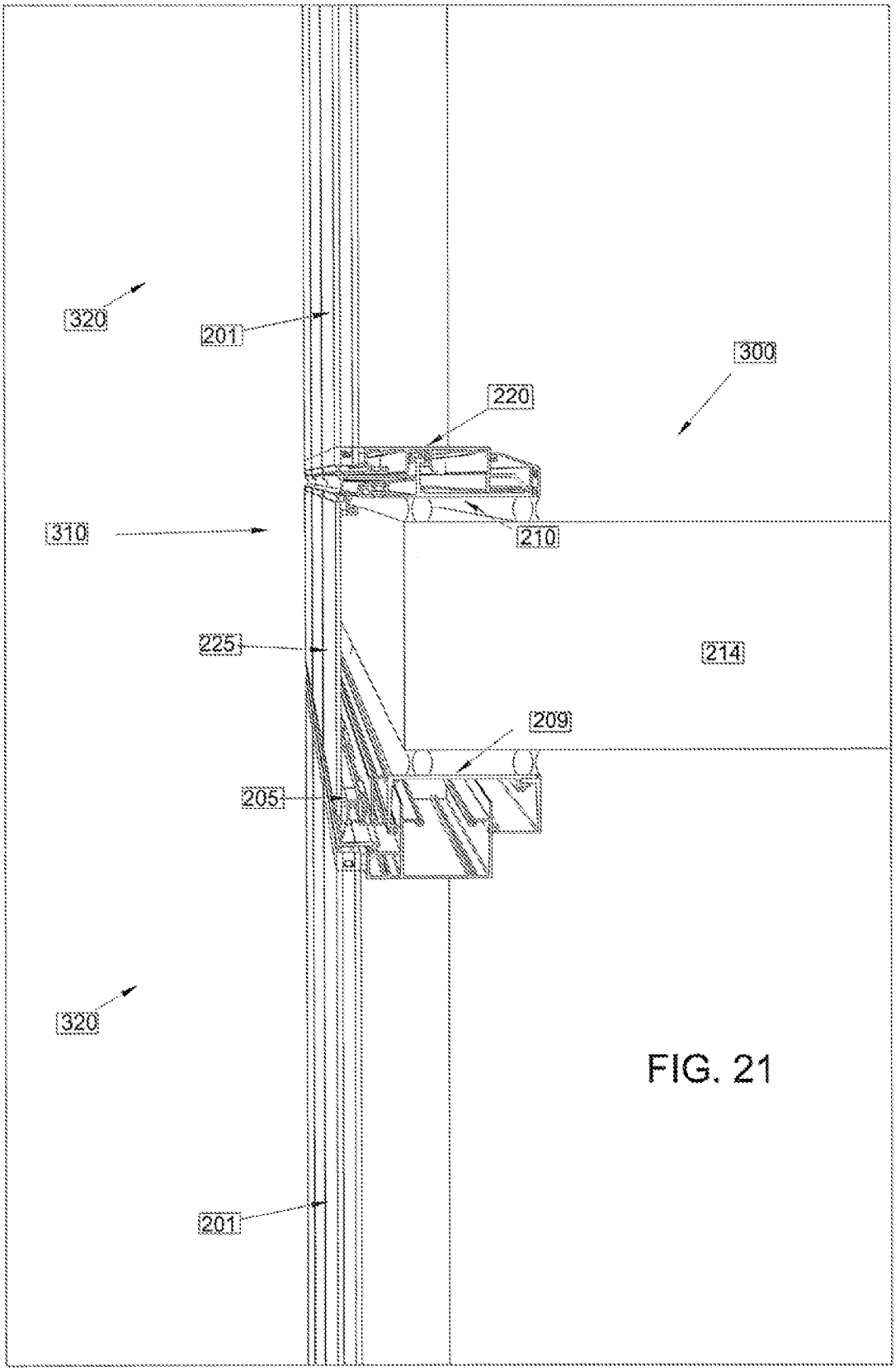
FIG. 21 is a diagram that illustrates a side perspective view of an exemplary second embodiment of a window wall system with slab edge covers flushly aligned with adjacent window wall panels in accordance with an embodiment of the present invention.
Figure 22:
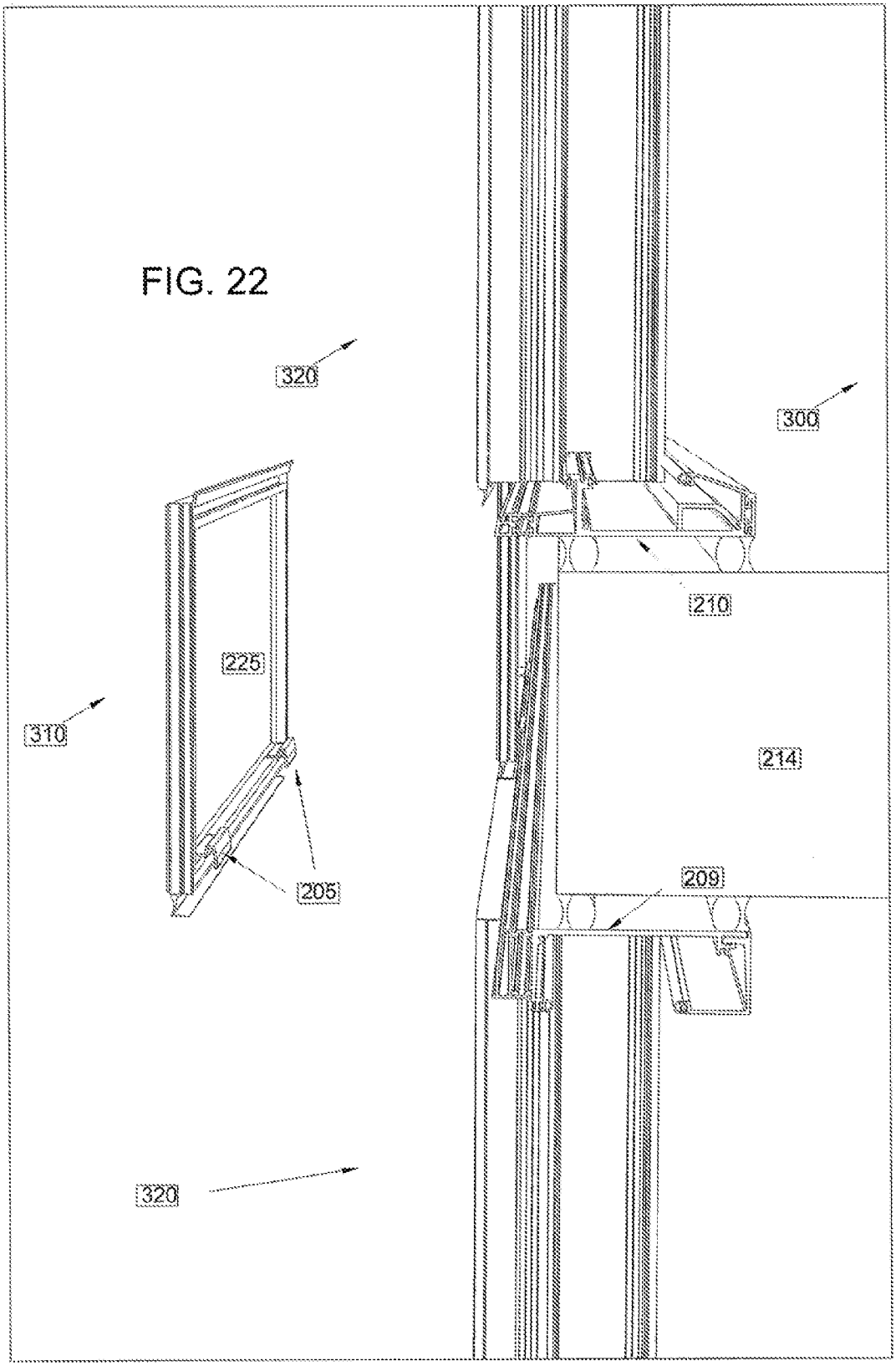
FIG. 22 is a diagram that illustrates a side perspective view of an exemplary second embodiment of a window wall system with a detached slab edge cover in accordance with an embodiment of the present invention.

FIG. 19 is a diagram that illustrates a front side perspective view of an exemplary second embodiment of a window wall system 300 with slab edge covers 310 flushly aligned with adjacent window wall panels 320 in accordance with an embodiment of the present invention. FIG. 20 is a diagram that illustrates a rear side perspective view of an exemplary second embodiment of a window wall system 300 with slab edge covers 310 flushly aligned with adjacent window wall panels 320 in accordance with an embodiment of the present invention. FIG. 21 is a diagram that illustrates a side perspective view of an exemplary second embodiment of a window wall system 300 with slab edge covers 310 flushly aligned with adjacent window wall panels 320 in accordance with an embodiment of the present invention. FIG. 22 is a diagram that illustrates a side perspective view of an exemplary second embodiment of a window wall system 300 with a detached slab edge cover 310 in accordance with an embodiment of the present invention.

Referring to FIGS. 19-22, the window wall system 300 comprises head receptors 209, sill receptors 210, window wall panels 320, and a slab edge cover 310. The slab edge cover is flushly aligned in a vertical plane with the window wall panels 320 when installed, as illustrated in FIGS. 19-21. The slab edge cover 310 can be detached from the receptors 209, 210, as illustrated in FIG. 22. The sill receptors 210 and head receptors 209 are securely attached to a slab 214 and are configured to receive window wall panels 320 and slab edge covers 310. The slab edge cover 310 and window wall panels 320 may be a four-sided structurally glazed system comprising slab cover infill 225 and window wall panel infill 1, respectively. The slab edge cover 310 may include one or more panel clips 205 for detachably coupling the slab edge cover 310 to the head receptor 209.

The window wall system 300 illustrated in FIGS. 19-22 shares various characteristics with the window wall system 300 illustrated in FIGS. 16-18 and 26, as described above.

Figure 23:
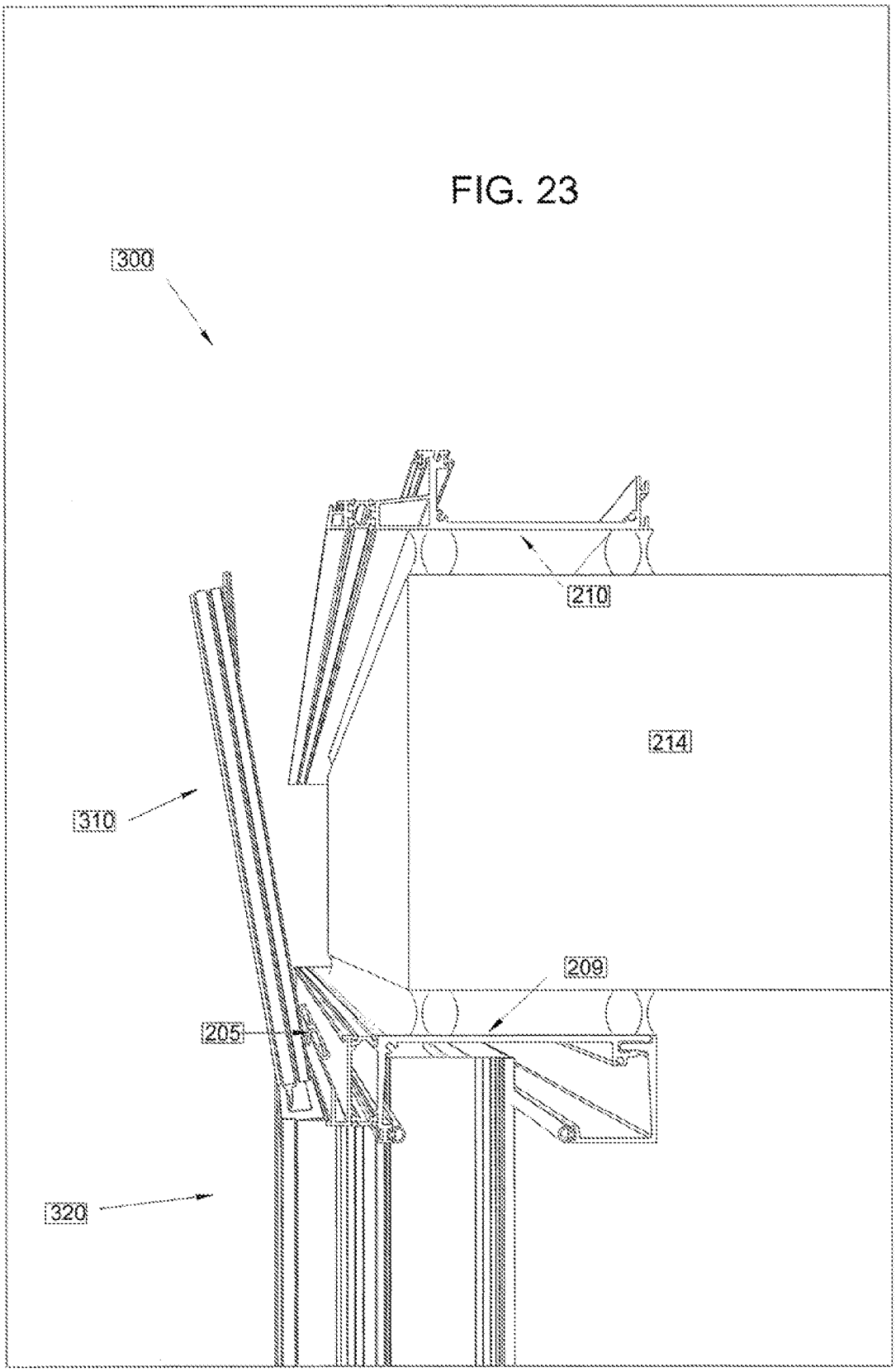
FIG. 23 is a diagram that illustrates a side perspective view of an exemplary second embodiment of a window wall system with a slab edge cover flushly aligned with an adjacent window wall panel during an installation procedure in accordance with an embodiment of the present invention.
Figure 24:
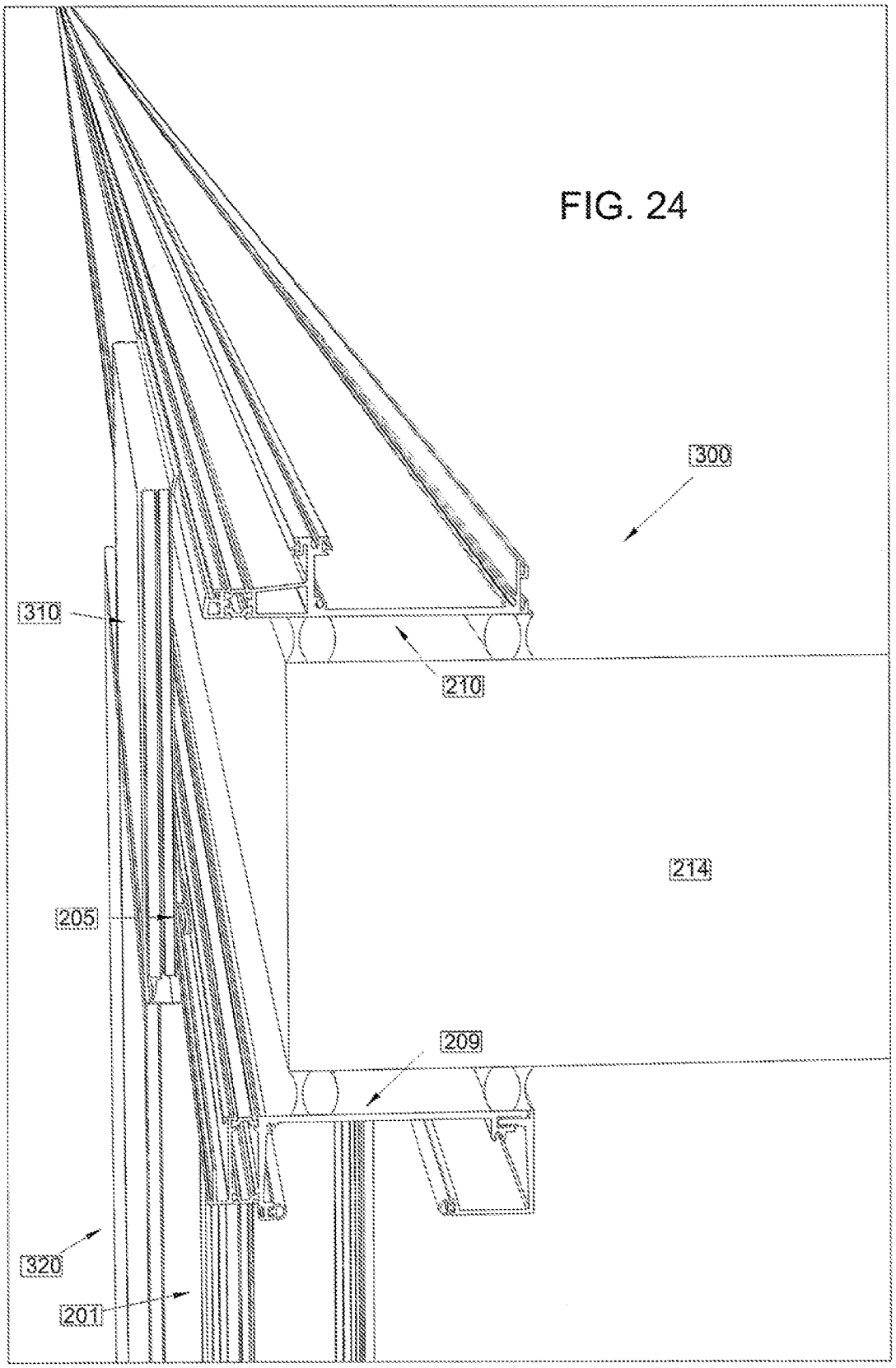
FIG. 24 is a diagram that illustrates a side perspective view of an exemplary second embodiment of a window wall system with a slab edge cover flushly aligned with an adjacent window wall panel during an installation procedure in accordance with an embodiment of the present invention.
Figure 25:
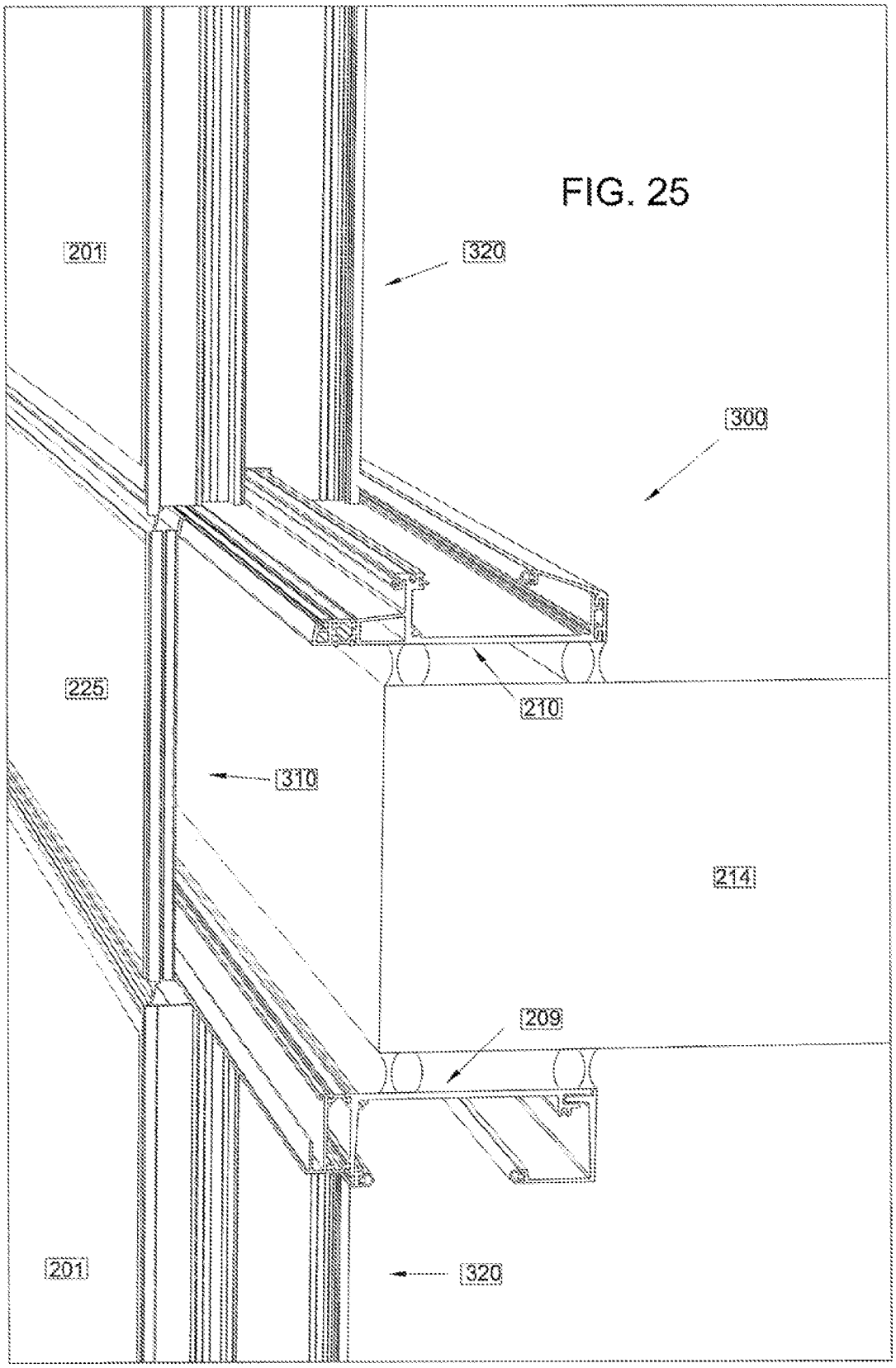
FIG. 25 is a diagram that illustrates a front side perspective view of an exemplary second embodiment of a window wall system with a slab edge cover flushly aligned with adjacent window wall panels during an installation procedure in accordance with an embodiment of the present invention.

FIGS. 23-25 are diagrams that illustrate side perspective views of an exemplary second embodiment of a window wall system 300 with slab edge covers 310 flushly aligned with adjacent window wall panels 320 during an installation procedure in accordance with an embodiment of the present invention. Referring to FIGS. 23-25, the window wall system 300 comprises head receptors 209, sill receptors 210, window wall panels 320, and a slab edge cover 310 flushly aligned in a vertical plane with the window wall panels 320 and detachably coupled to the receptors 209, 210. The sill receptors 210 and head receptors 209 are securely attached to a slab 214 and are configured to receive window wall panels 320 and slab edge covers 310. The slab edge cover 310 and window wall panels 320 may be a four-sided structurally glazed system comprising slab cover infill 225 and window wall panel infill 1, respectively. The slab edge cover 310 may include one or more panel clips 205 for detachably coupling the slab edge cover 310 to the head receptor 209.

Referring to FIG. 23, the slab edge cover 310 is shown during an installation procedure, where the panel clips 205 of the slab edge cover 310 are received at the head receptor 209. Referring to FIG. 24, the slab edge cover 310 is tilted toward the slab 214 such that the slab edge cover 310 is received at the sill receptor 210. The slab edge cover 310 can be secured at the sill receptor 210 using a clip screw, as discussed with regard to FIG. 16, or any suitable attachment mechanism. Referring to FIG. 25, after installing the slab edge cover 310, a window wall panel 320 above the slab edge cover 310 can be installed.

The window wall system 300 illustrated in FIGS. 23-25 shares various characteristics with the window wall system 300 illustrated in FIGS. 16-22 and 26, as described above.

Figure 27:
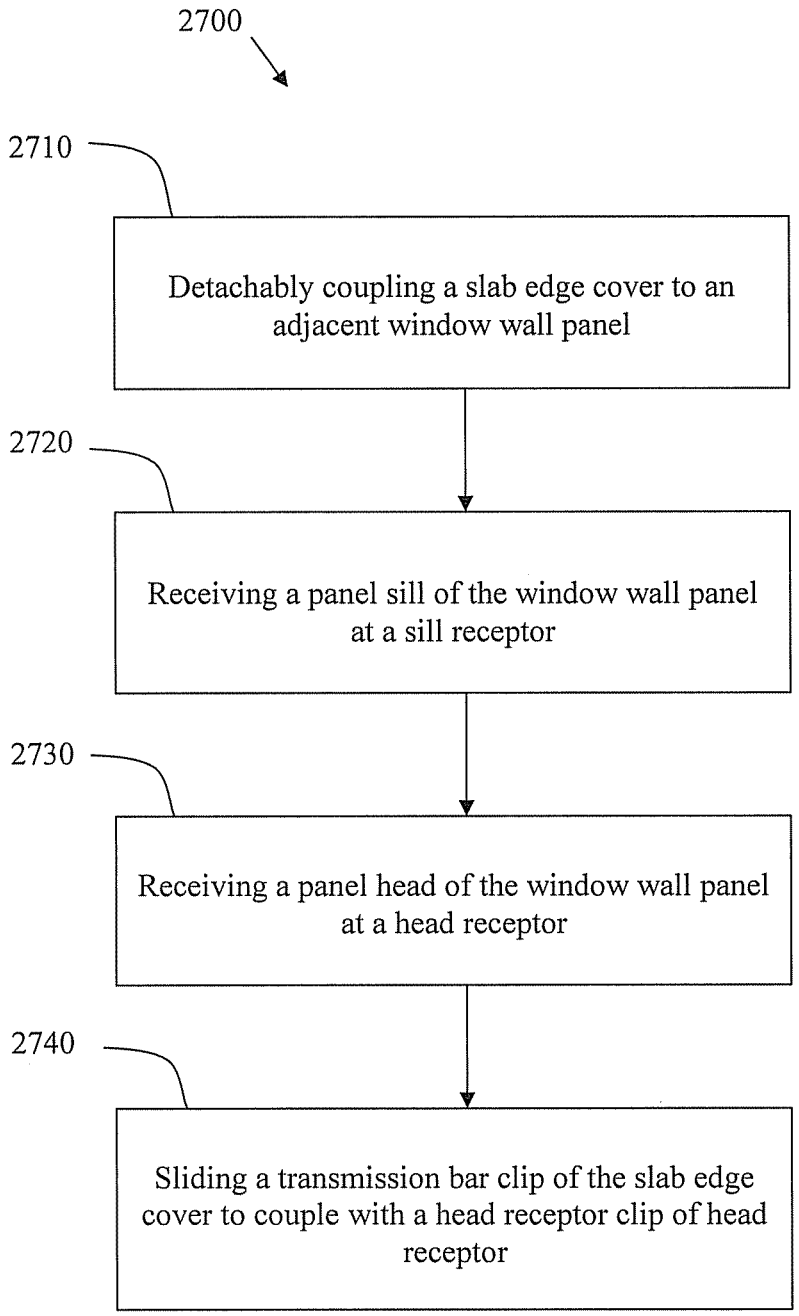
FIG. 27 is a flow diagram that illustrates exemplary steps for installing a slab edge cover to flushly align with an adjacent window wall panel in an exemplary first embodiment of a window wall system in accordance with an embodiment of the present invention.

FIG. 27 is a flow diagram 2700 that illustrates exemplary steps for installing a slab edge cover 110 to flushly align with an adjacent window wall panel 120 in an exemplary first embodiment of a window wall system 100 in accordance with an embodiment of the present invention. Referring to FIG. 27, there is shown a flow diagram 2700, which illustrates exemplary steps for installing a slab edge cover 110. At step 2710, the slab cover frame 28 is detachably coupled to an adjacent window wall panel 120. At step 2720, a panel sill 22 of the window wall panel 120 is received at a sill receptor 11. At step 2730, a panel head 21 of the window wall panel 120 is received at a head receptor 10. At step 2740, a sliding transmission bar clip 5 of the slab edge cover 110 is slid to couple with a head receptor clip 16 of the head receptor 10. Although the method 2700 is described with reference to the exemplary elements of the window wall system 100 described above, it should be understood that other implementations are possible.

At step 2710, the slab cover frame 28 is detachably coupled to an adjacent window wall panel 120. For example, the vertical sides of the slab cover frame 28 can include hanging studs 24 for detachably coupling to clip connections 26 of a support arm 25 that extends vertically above the slab edge cover 110 and attaches to the vertical sides of the adjacent window wall panel 120 frame. In various embodiments, the support arm 25 can detach from the slab edge cover frame 28 at the clip connections 26 by lifting the slab edge cover 110 toward the adjacent window wall panel 120 and pulling out the slab edge cover 110. Certain embodiments provide a set screw 23 and/or wedge block between the slab edge cover 110 and the adjacent window wall panel 120 to prevent unintentional removal of the slab edge cover 110 from the adjacent window wall panel 120. As another example, the slab cover frame 28 may include a protrusion for detachably coupling with an integral panel clip 6 of an adjacent window wall panel sill 22. The slab cover frame 28 protrusion assists in securing the slab edge cover 110 to the adjacent window wall panel 120 when coupled with the integral panel clip 6.

At step 2720, a panel sill 22 of the window wall panel 120 is received at a sill receptor 11, as illustrated in FIG. 7, for example. As an example, the sill receptor 11 can be configured to receive a panel sill 22 of a window wall panel 120 at an upward projection 31, commonly referred to as a "chicken head." The panel sill 22 may dead load on the upward projection 31 to provide a press or wedge fit, for example.

At step 2730, a panel head 21 of the window wall panel 120 is received at a head receptor 10, as illustrated in FIG. 8, for example. As an example, the window wall panel 120 detachably coupled to the slab edge cover 110 can be tilted outward such that the window wall panel 120 is pressed against an arm 34 of the head receptor 10. A head receptor drive-on 12 can be attached to the head receptor 10 after the window wall panel 120 is received against the head receptor arm 34 to compress the panel head 21 against the head receptor arm 34 such that the window wall panel 120 is secured in place at the head receptor 10.

At step 2740, a sliding transmission bar clip 5 of the slab edge cover 110 is slid to couple with a head receptor clip 16 of the head receptor 10. The sliding transmission bar clip 5 is a mechanism for detachably coupling the slab edge cover 110 to a head receptor 10. In various embodiments, the sliding transmission bar clip 5 is a continuous transmission bar comprising slots 33 for receiving a screw 32 to slidably attach the sliding transmission bar clip 5 to the slab edge cover frame 28, for example. In certain embodiments, the sliding transmission bar clip 5 can extend horizontally beyond an edge of the slab cover frame 28 when the slab edge cover 110 is in an open position (i.e., when the slab edge cover 110 is not coupled to the head receptor 10), as illustrated in FIGS. 13-14. The sliding transmission bar clip 5 can lock the slab edge cover 110 to the head receptor 10 by applying a horizontal force at an impact point at the edge of the sliding transmission bar clip 5 that extends beyond the slab cover frame 28, for example. The horizontal force applied to the sliding transmission bar clip 5 forces the sliding transmission bar clip 5 to slide, as guided by slots 33, such that the sliding bar clip 5 slides into a locked position behind the slab edge cover 110, as illustrated in FIG. 15, coupling the slab edge cover 110 with the head receptor clip 16 of the head receptor 10.

Figure 28:
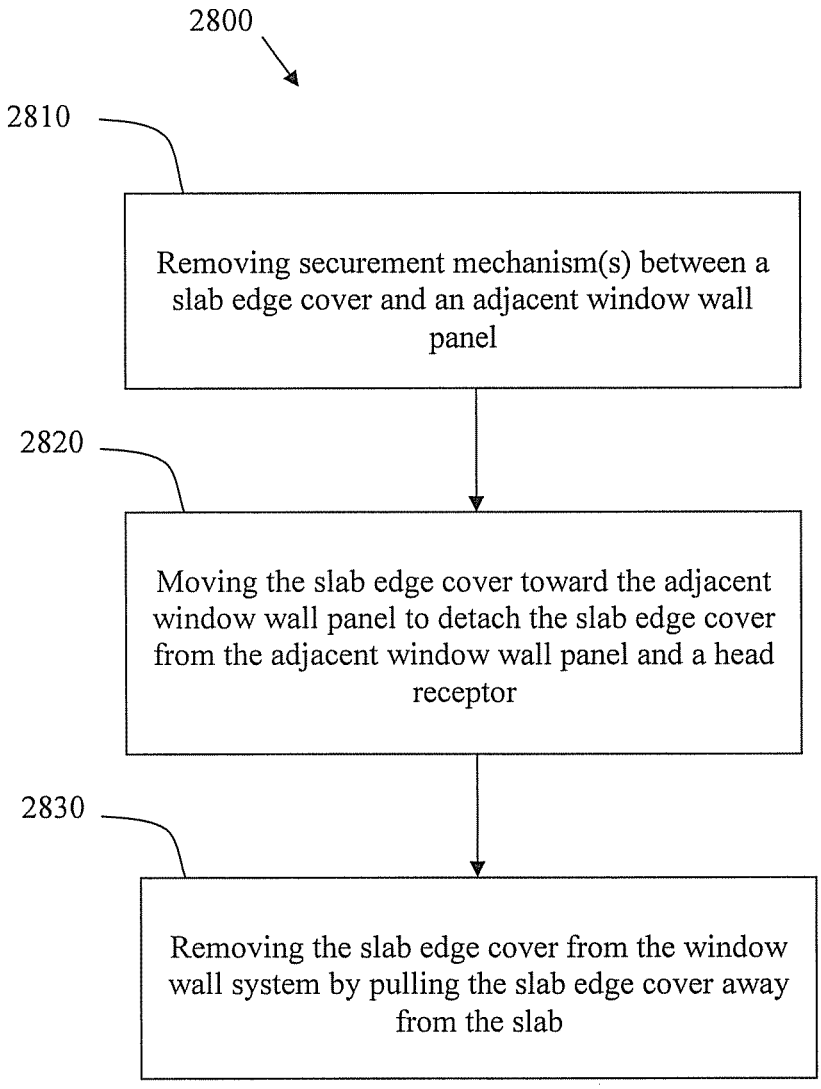
FIG. 28 is a flow diagram that illustrates exemplary steps for removing an installed slab edge cover flushly aligned with an adjacent window wall panel in an exemplary first embodiment of a window wall system in accordance with an embodiment of the present invention.

FIG. 28 is a flow diagram 2800 that illustrates exemplary steps for removing an installed slab edge cover 110 flushly aligned with an adjacent window wall panel 120 in an exemplary first embodiment of a window wall system 100 in accordance with an embodiment of the present invention. Referring to FIG. 28, there is shown a flow diagram 2800, which illustrates exemplary steps for removing a slab edge cover 110. At step 2810, securement mechanism(s) 23 between a slab edge cover 110 and an adjacent window wall panel 120 are removed. At step 2820, the slab edge cover 110 is moved toward the adjacent window wall panel 120 to detach the slab edge cover 110 from the adjacent window wall panel 120 and a head receptor 10. At step 2830, the slab edge cover 110 is removed from the window wall system 100 by pulling the slab edge cover 110 away from the slab 15. Although the method 2800 is described with reference to the exemplary elements of the window wall system 100 described above, it should be understood that other implementations are possible.

At step 2810, securement mechanism(s) 23 between a slab edge cover 110 and an adjacent window wall panel 120 are removed. For example, a set screw 23 and/or wedge block can be affixed between the slab edge cover 110 and the above window wall panel 120 to prevent unintentional removal of the slab edge cover 110 from the adjacent window wall panel 120 and the head receptor 10. The set screw 23 and/or wedge block may be removed to allow the slab edge cover 110 to be lifted such that the slab edge cover can detach from an adjacent window wall panel 120 and the head receptor 10, for example.

At step 2820, the slab edge cover 110 is moved toward the adjacent window wall panel 120 to detach the slab edge cover 110 from the adjacent window wall panel 120 and a head receptor 10. For example, as described in connection with step 2710 of the installation procedure 2700, the vertical sides of the slab cover frame 28 can include hanging studs 24 for detachably coupling to clip connections 26 of a support arm 25 that extends vertically above the slab edge cover 110 and attaches to the vertical sides of the adjacent window wall panel 120 frame. Further, the slab cover frame 28 may include a protrusion for detachably coupling with an integral panel clip 6 of an adjacent window wall panel sill 22. Step 2740 of the installation procedure 2700 describes sliding a sliding transmission bar clip 5 of the slab edge cover 110 to couple with a head receptor clip 16 of the head receptor 10.

In various embodiments, the support arm 25 can detach from the slab edge cover frame 28 at the clip connections 26 by lifting the slab edge cover 110 toward the adjacent window wall panel 120 and pulling out the slab edge cover 110. Further, as the slab edge cover 110 is lifted, the integral panel clip 6 detaches from the protrusion of the slab cover frame 28, and the sliding transmission bar clip 5 detaches from the head receptor clip 16.

At step 2830, after detaching the slab edge cover 110 from the adjacent window wall panel 120 and a head receptor 10 at step 2820, the slab edge cover 110 is removed from the window wall system 100 by pulling the slab edge cover 110 away from the slab 15.

Figure 29:
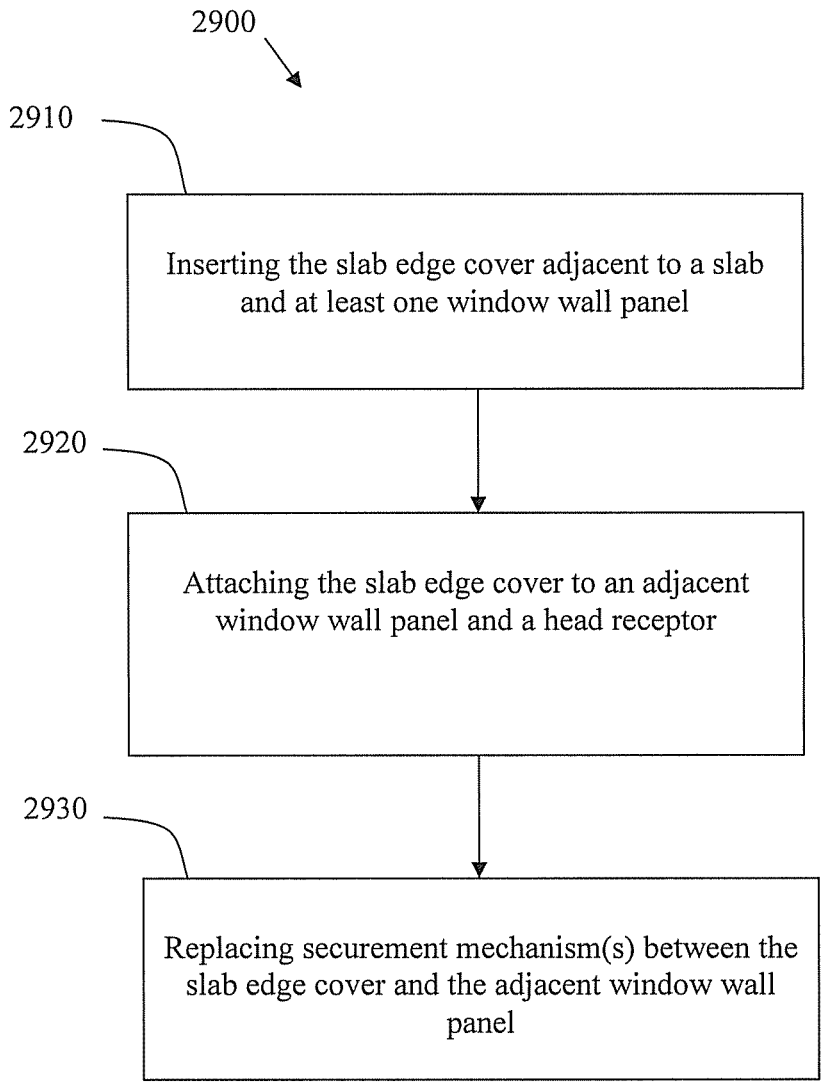
FIG. 29 is a flow diagram that illustrates exemplary steps for reattaching a slab edge cover to flushly align with an adjacent window wall panel in an exemplary first embodiment of a window wall system in accordance with an embodiment of the present invention.

FIG. 29 is a flow diagram 2900 that illustrates exemplary steps for reattaching a slab edge cover 110 to flushly align with an adjacent window wall panel 120 in an exemplary first embodiment of a window wall system 100 in accordance with an embodiment of the present invention. Referring to FIG. 29, there is shown a flow diagram 2900, which illustrates exemplary steps for reattaching a slab edge cover 110. At step 2910, a slab edge cover 110 is inserted adjacent to a slab 15 and at least one window wall panel 120. At step 2920, the slab edge cover 110 is attached to an adjacent window wall panel 120 and a head receptor 10. At step 2930, securement mechanism(s) 23 between the slab edge cover 110 and the adjacent window wall panel 120 are replaced. Although the method 2900 is described with reference to the exemplary elements of the window wall system 100 described above, it should be understood that other implementations are possible.

At step 2910, a slab edge cover 110 is inserted adjacent to a slab 15 and at least one window wall panel 120. For example, removing the slab edge cover 110 from the window wall system 100, as described in connection with step 2830 of the slab edge cover detachment procedure 2800, leaves a slab edge cover opening adjacent to the slab 15 and at least one window panel 120, as illustrated in FIG. 22, for example. The slab edge cover 110 is inserted into the slab edge cover opening, which is adjacent to the slab 15 and at least one window wall panel 120, to reattach the slab edge cover 110 to the window wall system 100.

At step 2920, the slab edge cover 110 is attached to an adjacent window wall panel 120 and a head receptor 10. For example, the vertical sides of a slab cover frame 28 of the slab edge cover 110 can include hanging studs 24 for detachably coupling to clip connections 26 of a support arm 25 that extends vertically above the slab edge cover 110 and attaches to the vertical sides of the adjacent window wall panel 120 frame. Further, the slab cover frame 28 may include a sliding transmission bar clip 5 at the base of the slab cover frame 28, and a protrusion at the top of the slab cover frame 28. The protrusion can detachably couple with an integral panel clip 6 of an adjacent window wall panel sill 22. The sliding transmission bar clip 5 may detachable couple with a head receptor clip 16 of the head receptor 10.

At step 2930, securement mechanism(s) 23 between the slab edge cover 110 and the adjacent window wall panel 120 are replaced. For example, a set screw 23 and/or wedge block can be affixed between the slab edge cover 110 and the adjacent window wall panel 120 to prevent unintentional removal of the slab edge cover 110 from the above window wall panel 120 and the head receptor 10.

Figure 30:
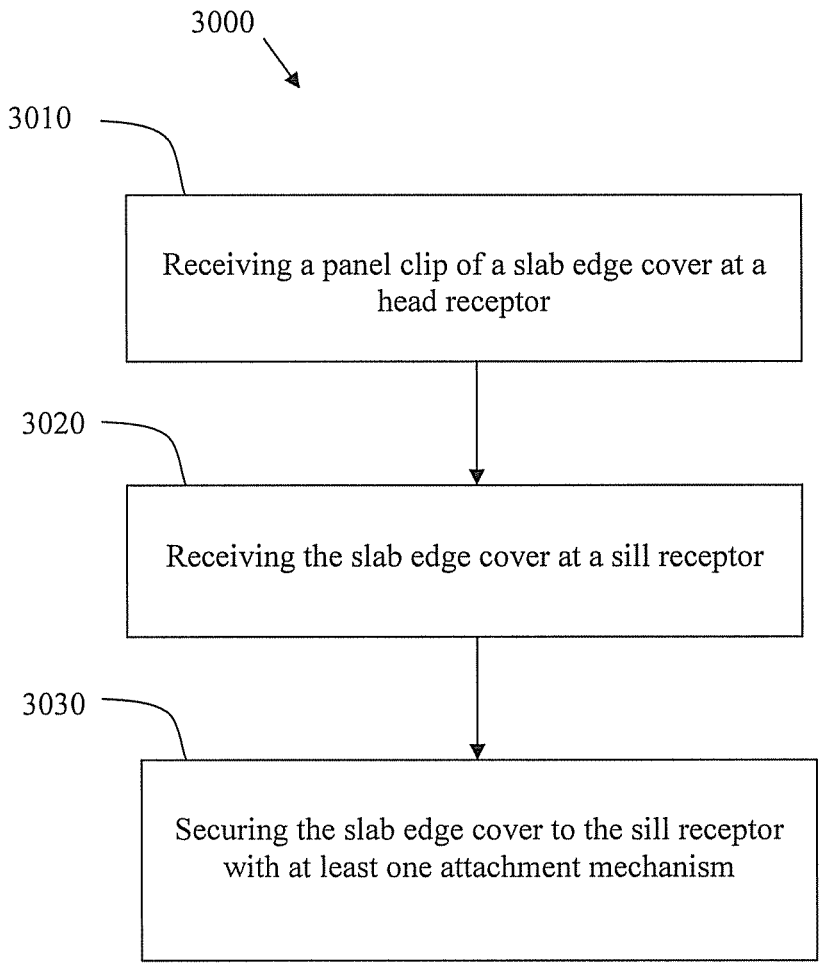
FIG. 30 is a flow diagram that illustrates exemplary steps for installing a slab edge cover 310 to flushly align with an adjacent window wall panel 320 in an exemplary second embodiment of a window wall system 300 in accordance with an embodiment of the present invention.

FIG. 30 is a flow diagram 3000 that illustrates exemplary steps for installing a slab edge cover 310 to flushly align with an adjacent window wall panel 320 in an exemplary second embodiment of a window wall system 300 in accordance with an embodiment of the present invention. Referring to FIG. 30, there is shown a flow diagram 3000, which illustrates exemplary steps for installing a slab edge cover 310. At step 3010, a panel clip 205 of a slab edge cover 310 is received at a head receptor 209. At step 3020, the slab edge cover 310 is received at a sill receptor 210. At step 3030, the slab edge cover 310 is secured to the sill receptor 210 with at least one attachment mechanism 221A. Although the method 3000 is described with reference to the exemplary elements of the window wall system 300 described above, it should be understood that other implementations are possible.

At step 3010, a panel clip 205 of a slab edge cover 310 is received at a head receptor 209. The panel clip 205 is a mechanism for detachably coupling the slab edge cover 310 to the head receptor 209. In various embodiments, one or more panel clips 205 are affixed to the glazing beading/slab cover frame 203 of the slab edge cover 310 by clip screw(s) 221B. The one or more panel clips 205 detachably couple with the head receptor 209 at clip connection 222, as illustrated in FIG. 23, for example. The clip connection 222 may be a continuous clip that substantially spans the length of the head receptor 209 or can be non-continuous clip(s) positioned to correspond with the one or more panel clips 205 of the slab edge cover 310, for example.

At step 3020, the slab edge cover 310 is received at a sill receptor 210. For example, the slab edge cover 310 can be tilted toward the slab 214 such that the slab edge cover 310 is received at the sill receptor 210, as illustrated in FIG. 24.

At step 3030, the slab edge cover 310 is secured to the sill receptor 210 with at least one attachment mechanism 221A. For example, the slab edge cover 310 can be secured at the sill receptor 210 using a clip screw 221A, or any suitable attachment mechanism. In various embodiments, the clip screw 221A fastens glazing beading/slab cover frame 203 of the slab edge cover 310 to a sill clip 229 of the sill receptor 210 to assist in securing the slab edge cover 310 to the sill receptor 210.

Figure 31:
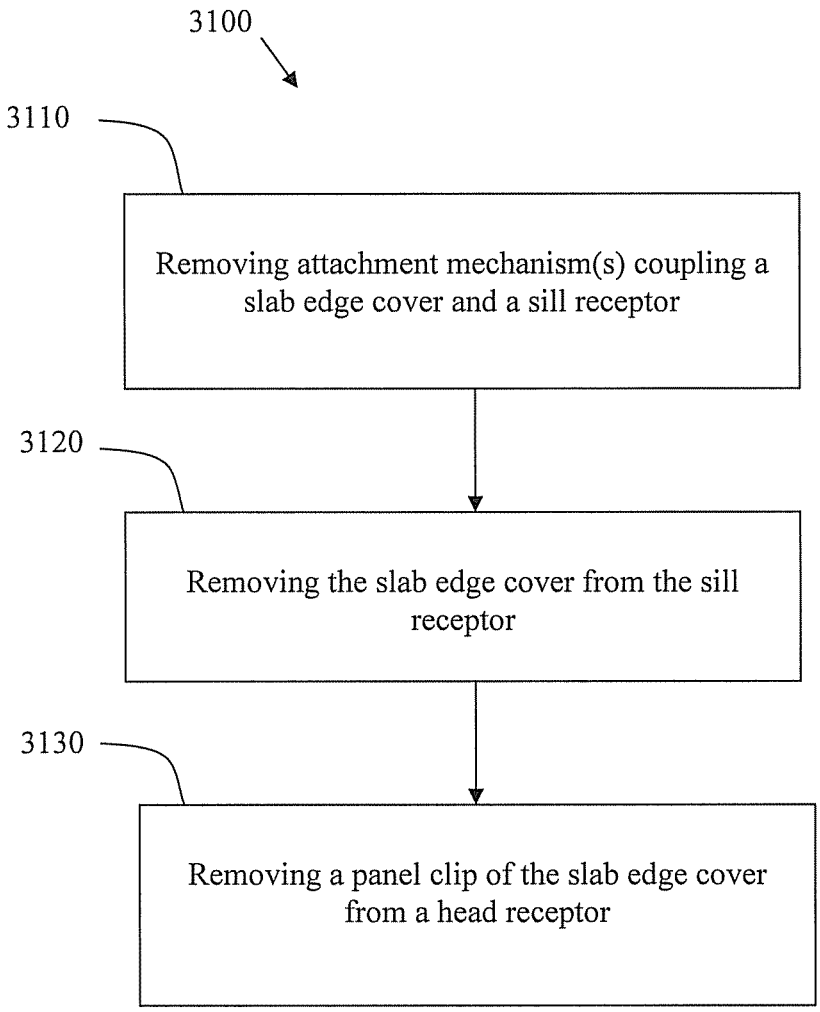
FIG. 31 is a flow diagram that illustrates exemplary steps for removing a slab edge cover flushly aligned with an adjacent window wall panel in an exemplary second embodiment of a window wall system in accordance with an embodiment of the present invention.

FIG. 31 is a flow diagram 3100 that illustrates exemplary steps for removing a slab edge cover 310 flushly aligned with an adjacent window wall panel 320 in an exemplary second embodiment of a window wall system 300 in accordance with an embodiment of the present invention. Referring to FIG. 31, there is shown a flow diagram 3100, which illustrates exemplary steps for removing a slab edge cover 310. At step 3110, at least one attachment mechanism 221A coupling a slab edge cover 310 and a sill receptor 210 is removed. At step 3120, the slab edge cover 310 is removed from the sill receptor 210. At step 3130, a panel clip 205 of the slab edge cover 310 is removed from a head receptor 209. Although the method 3100 is described with reference to the exemplary elements of the window wall system 300 described above, it should be understood that other implementations are possible.

At step 3110, at least one attachment mechanism 221A coupling a slab edge cover 310 and a sill receptor 210 is removed. For example, a clip screw 221A, or any suitable attachment mechanism, that fastens a sill clip 229 of the sill receptor 210 to glazing beading/slab cover frame 203 of the slab edge cover 310 can be removed.

At step 3120, the slab edge cover 310 is removed from the sill receptor 210. For example, after removing the at least one attachment mechanism 221A at step 3110, the slab edge cover 310 can be tilted away from the slab 214 to remove the slab edge cover 310 from the sill receptor 210.

At step 3130, a panel clip 205 of the slab edge cover 310 is removed from a head receptor 209. For example, the panel clip 205 of the slab edge cover 310 can be unhooked from a clip connection 222 of the head receptor 209 to remove the slab edge cover 310 from the window wall system 300.

Certain embodiments of the present invention may omit one or more steps of flowcharts 2700, 2800, 2900, 3000, 3100, and/or perform the steps in a different order than the order listed, and/or combine certain of the steps discussed above. For example, some steps may not be performed in certain embodiments of the present invention. As a further example, certain steps may be performed in a different temporal order, including simultaneously, than listed above.

Aspects of the present invention provide a window wall system 100 including a sill receptor 11 configured to fixably attach to a top surface of a slab 15. The window wall system 100 may include a head receptor 10 configured to fixably attach to an underside surface of the slab 15. The window wall system 100 can include a window wall panel 120 including panel infill 1 and a panel sill 22 configured to detachably couple to the sill receptor 11. The window wall system 100 may include a slab edge cover 110 including cover infill 29. The slab edge cover 110 can be configured to detachably couple to the window wall panel 120 and the head receptor 10. In various embodiments, an exterior surface of the panel infill 1 and an exterior surface of the cover infill 29 are configured to flushly align when the slab edge cover 110 is detachably coupled to the window wall panel 120.

In various embodiments, each of the window wall panel 120 and the slab edge cover 110 is a four-sided structurally glazed system. The panel infill 1 can be insulated vision glass. The cover infill 29 may be spandrel glass. The sill receptor 11 can comprise an upward projection 31, and the panel sill 22 may be configured to detachably couple to the sill receptor 11 by dead loading on the upward projection 31.

In certain embodiments, the slab edge cover 110 may comprise a sliding transmission bar clip 5, and the head receptor 10 can comprise one or more head receptor clips 16. The sliding transmission bar clip 5 may be configured to detachably couple to the one or more head receptor clips 16 when the sliding transmission bar clip 5 is slid from an open position to a locked position. In various embodiments, at least a portion of the sliding transmission bar clip 5 may extend horizontally beyond a vertical side of the slab edge cover 110 when in the open position. The portion of the sliding transmission bar clip 5 can be behind the slab edge cover 110 when in the locked position. In certain embodiments, the sliding transmission bar clip 5 may comprise one or more slots 33 and a sliding attachment mechanism 32 received at the slots 33. The sliding attachment mechanism 32 can be configured to slidably attach the sliding transmission bar clip 5 to the slab edge cover 110. Aspects of the present invention provide that a horizontal force may be applied to the sliding transmission bar clip 5 to slide the sliding transmission bar clip 5 as guided by the slots 33 to couple with the one or more head receptor clips 16.

In various embodiments, the sliding transmission bar clip 5 may be horizontally slidable in a track coupled to the slab edge cover 110. The sliding transmission bar clip 5 can comprise one or more clips that detachably couple with the one or more head receptor clips 16 when slid from the open position to the locked position. In certain embodiments, at least a portion of the sliding transmission bar clip 5 may extend horizontally beyond a vertical side of the slab edge cover 110 when in the open position. The portion of the sliding transmission bar clip 5 can be behind the slab edge cover 110 when in the locked position. In various embodiments, the sliding transmission bar clip 5 and/or the one or more head receptor clips 16 may comprise an anti-friction pad 17.

In certain embodiments, the slab edge cover 110 can comprise a stationary transmission bar clip 5, and the head receptor 10 may comprise one or more head receptor clips 16. The stationary transmission bar clip 5 can be configured to detachably couple to the one or more head receptor clips 16. In various embodiments, the window wall system 100 may comprise an attachment mechanism 30 for fixably attaching the sill receptor 11 to the top surface of the slab 15. When the panel sill 22 is detachably coupled to the sill receptor 11 and the attachment mechanism 30 is fixably attaching the sill receptor 11 to the top surface of the slab 15, the panel sill 22 may extends a first horizontal distance from a nearest vertical edge of the slab 15; the attachment mechanism 30 can be attached at a second horizontal distance from the nearest vertical edge of the slab 15; and, the second horizontal distance may be greater than the first horizontal distance.

In various embodiments, the slab edge cover 110 may be detachably coupled to the window wall panel 120 before the window wall panel 120 is detachably coupled to the sill receptor 11. Aspects of the present invention provide that each vertical side edge of the slab edge cover 110 can comprise a support arm gasket 27 configured to direct water behind the slab edge cover 110 and out a front of the window wall system 100 between the slab edge cover 110 and a window wall panel 120 below the slab edge cover 110.

In certain embodiments, the window wall system 100 may comprise support arms 25 attached to each of the vertical side edges of the window wall panel 120. The support arms 25 can extend below the window wall panel 120 to detachably couple with the slab edge cover 110. Aspects of the present invention provide that each of the support arms 25 may comprise one or more clip connections 26. The slab edge cover 110 can comprise hanging studs 24 for detachably coupling to the one or more clip connections 26 of each of the support arms 25. In various embodiments, the slab edge cover 100 may comprise one or more protrusions. The panel sill 22 can comprise one or more integral panel clips 6 configured to detachably couple with one or more protrusions.

Various embodiments provide a method 2700 for installing a slab edge cover 110 of a window wall system 100. The method 2700 includes detachably coupling 2710 the slab edge cover 110 to a window wall panel 120. The method 2700 includes receiving 2720 a panel sill 22 of the window wall panel 120 at a sill receptor 11. The method includes receiving 2730 a panel head 21 of the window wall panel 120 at a head receptor 10. The method 2700 includes sliding 2740 a transmission bar clip 5 of the slab edge cover 110 to couple the slab edge cover 110 to the head receptor 10.

Certain embodiments provide a window wall system 300. The window wall system 300 can comprise a sill receptor 210 configured to fixably attach to a top surface of a slab 214. The window wall system 300 may comprise a head receptor 209 configured to fixably attach to an underside surface of the slab 214. The window wall system 300 can comprise a window wall panel 320 comprising panel infill 201 and a panel sill 220 configured to detachably couple to the sill receptor 210. The window wall system 300 may comprise one or more slab edge covers 310 comprising cover infill 225. The one or more slab edge covers can be configured to detachably couple to the sill receptor 210 and the head receptor 209. In various embodiments, an exterior surface of the panel infill 201 and an exterior surface of the cover infill 225 can be configured to flushly align when the window wall panel 320 is detachably coupled to the sill receptor 210 and the at least one slab edge cover 310 is detachably coupled to the sill receptor 210 and the head receptor 209.

Aspects of the present invention provide that each of the window wall panel 320 and the one or more slab edge covers 310 may be a four-sided structurally glazed system. The panel infill 201 can be insulated vision glass. The cover infill 225 may be spandrel glass. The sill receptor 310 can comprise an upward projection 228 and the panel sill 220 may be configured to detachably couple to the sill receptor 210 by dead loading on the upward projection 228.

In various embodiments, the one or more slab edge covers 310 may comprise a plurality of slab edge covers 310 combined in a slab edge cover frame 203. In certain embodiments, the window wall system 300 can comprise an intermediate frame vertical 224 between each of the plurality of slab edge covers 310 combined in the slab edge cover frame 203.

In certain embodiments, the one or more slab edge covers 310 may comprise at least one panel clip 205. In various embodiments, the head receptor 209 can comprise one or more clip connections 222. The at least one panel clip 205 may be configured to detachably couple to the one or more clip connections 222 to detachably couple the one or more slab edge covers 310 to the head receptor 209. Aspects of the present invention provide that the window wall system 300 comprises an attachment mechanism 227 for fixably attaching the sill receptor 210 to the top surface of the slab 214. When the panel sill 220 is detachably coupled to the sill receptor 210 and the attachment mechanism 227 is fixably attaching the sill receptor 210 to the top surface of the slab 214, the panel sill 220 may extend a first horizontal distance from a nearest vertical edge of the slab 214; the attachment mechanism 227 can be attached at a second horizontal distance from the nearest vertical edge of the slab 214; and, the second horizontal distance may be greater than the first horizontal distance.

Various embodiments provide a method 3000 for installing a slab edge cover 310 of a window wall system 300. The method 3000 can comprise receiving 3010 a panel clip 205 of the slab edge cover 310 at a head receptor 209. The method 3000 may comprise receiving 3020 the slab edge cover 310 at the sill receptor 210. The method 3000 can comprise securing 3030 the slab edge cover 310 to the sill receptor 210 with at least one attachment mechanism 229. In certain embodiments, the slab edge cover 310 and a window wall panel 320 installed adjacent to the slab edge cover 310 may be flushly aligned. In various embodiments, each of the window wall panel 320 and the slab edge cover 310 can be a four-sided structurally glazed system.

While the present invention has been described with reference to certain embodiments, it will be understood by those skilled in the art that various changes may be made and equivalents may be substituted without departing from the scope of the present invention. In addition, many modifications may be made to adapt a particular situation or material to the teachings of the present invention without departing from its scope. Therefore, it is intended that the present invention not be limited to the particular embodiment disclosed, but that the present invention will include all embodiments falling within the scope of the appended claims.

What is claimed is:

1. A window wall system comprising:

a sill receptor configured to attach to a top surface of a slab;

a head receptor configured to attach to an underside surface of the slab;

a window wall panel comprising:

vertical side edges, panel infill, and a panel sill configured to detachably couple to the sill receptor;

a slab edge cover configured to detachably couple to the window wall panel and the head receptor; and a support arm attached to each of the vertical side edges of the window wall panel, each of the support arms extending below the window wall panel to detachably couple with the slab edge cover, wherein an exterior surface of the panel infill and an exterior surface of the slab edge cover are configured to flushly align when the slab edge cover is detachably coupled to the window wall panel.

2. The window wall system according to claim 1, wherein each of the window wall panel and the slab edge cover is a four-sided structurally glazed system.

3. The window wall system according to claim 1, wherein the panel infill is insulated vision glass.

4. The window wall system according to claim 1, wherein the slab edge cover comprises cover infill, wherein the cover infill is spandrel glass.

5. The window wall system according to claim 1, wherein:

the slab comprises a slab edge facing an exterior of a building side, the slab edge extends between the top surface of the slab and the underside surface of the slab, the top surface of the slab and the underside surface of the slab are on an interior of the building side of the slab edge, the sill receptor comprises an upward projection positioned above the top surface of the slab on the interior of the building side of the slab edge, and the panel sill is configured to detachably couple to the sill receptor by dead loading on the upward projection.

6. The window wall system according to claim 1, wherein the slab edge cover comprises a sliding transmission bar clip, and the head receptor comprises at least one head receptor clip, the sliding transmission bar clip configured to detachably couple to the at least one head receptor clip when the sliding transmission bar clip is slid from an open position to a locked position.

7. The window wall system according to claim 6, wherein at least a portion of the sliding transmission bar clip extends horizontally beyond a vertical side of the slab edge cover when in the open position, and wherein the at least the portion of the sliding transmission bar clip is behind the slab edge cover when in the locked position.

8. The window wall system according to claim 7, wherein the sliding transmission bar clip comprises:

at least one slot, and a sliding attachment mechanism received at the at least one slot, the sliding attachment mechanism configured to slidably attach the sliding transmission bar clip to the slab edge cover.

9. The window wall system according to claim 8, wherein a horizontal force applied to the sliding transmission bar clip slides the sliding transmission bar clip as guided by the at least one slot to couple with the at least one head receptor clip.

10. The window wall system according to claim 6, wherein the sliding transmission bar clip is horizontally slidable in a track coupled to the slab edge cover, the sliding transmission bar clip comprising at least one clip that detachably couples with the at least one head receptor clip when slid from the open position to the locked position, wherein at least a portion of the sliding transmission bar clip extends horizontally beyond a vertical side of the slab edge cover when in the open position, and wherein the at least the portion of the sliding transmission bar clip is behind the slab edge cover when in the locked position.

11. The window wall system according to claim 6, wherein at least one of the sliding transmission bar clip and the at least one head receptor clip comprises an anti-friction pad.

12. The window wall system according to claim 1, wherein the slab edge cover comprises a stationary transmission bar clip, and the head receptor comprises at least one head receptor clip, the stationary transmission bar clip configured to detachably couple to the at least one head receptor clip.

13. The window wall system according to claim 1, comprising an attachment mechanism for fixably attaching the sill receptor to the top surface of the slab, wherein when the panel sill is detachably coupled to the sill receptor and the attachment mechanism is fixably attaching the sill receptor to the top surface of the slab:

the panel sill extends a first horizontal distance from a nearest vertical edge of the slab, the attachment mechanism is attached at a second horizontal distance from the nearest vertical edge of the slab, and the second horizontal distance is greater than the first horizontal distance.

14. The window wall system according to claim 1, wherein the slab edge cover is detachably coupled to the window wall panel before the window wall panel is detachably coupled to the sill receptor.

15. The window wall system according to claim 1, wherein the slab edge cover comprises a plurality of vertical side edges, and wherein each vertical side edge of the slab edge cover comprises a support arm gasket configured to direct water behind the slab edge cover and out a front of the window wall system between the slab edge cover and a window wall panel below the slab edge cover.

16. The window wall system according to claim 1, wherein each of the support arms comprises at least one clip connection, and wherein the slab edge cover comprises a plurality of hanging studs for detachably coupling to the at least one clip connection of each of the support arms.

17. The window wall system according to claim 1, wherein the slab edge cover comprises at least one protrusion, and wherein the panel sill comprises at least one integral panel clip configured to detachably couple with the at least one protrusion.

18. A method for installing a slab edge cover of a window wall system, the method comprising:

detachably coupling the slab edge cover to a window wall panel comprising vertical side edges, panel infill, and a panel sill, wherein a support arm attached to each of the vertical side edges of the window wall panel each extend below the window wall panel to detachably couple with the slab edge cover, and wherein an exterior surface of the panel infill and an exterior surface of the slab edge cover are configured to flushly align when the slab edge cover is detachably coupled to the window wall panel;

detachably coupling the panel sill of the window wall panel to a sill receptor configured to attach to a top surface of a slab;

receiving a panel head of the window wall panel at a head receptor configured to attach to an underside surface of the slab; and sliding a transmission bar clip of the slab edge cover to detachably couple the slab edge cover to the head receptor.

* * * * *